US005937586A

United States Patent [19]

Scherba

[11] Patent Number: 5,937,586

[45] **Date of Patent: *Aug. 17, 1999**

[54] INFLATABLE SKATING RINK

[75] Inventor: Robert J. Scherba, Richfield, Ohio

[73] Assignee: Scherba Industries, Inc., Cleveland, Ohio

[ * ] Notice: This patent is subject to a terminal disclaimer.

[21] Appl. No.: 08/696,485

[22] Filed: Aug. 14, 1996

Related U.S. Application Data

[63] Continuation-in-part of application No. 29/052,897, Apr. 8, 1996, which is a continuation-in-part of application No. 08/328,132, Oct. 24, 1994, Pat. No. 5,555,679.

[51] Int. Cl.[6] ..... A63C 19/10; E04B 1/34

[52] U.S. Cl. ..... 52/2.23; 52/2.24; 52/2.21; 52/2.22; 52/2.17; 472/92; 472/94; 472/134

[58] Field of Search ..... 52/2.11, 2.13, 52/2.17–2.24, 6; 472/92, 94, 134, 136; 405/5, 51; 5/710–713

[56] References Cited

U.S. PATENT DOCUMENTS

| | | | |
|---|---|---|---|
| 802,526 | 10/1905 | Russell | 5/711 |
| 2,830,606 | 4/1958 | Daugherty | 52/2.24 X |
| 3,274,624 | 9/1966 | Noerdinger | 5/710 |
| 3,428,974 | 2/1969 | Stuart | 5/710 |
| 3,898,775 | 8/1975 | Webb . | |
| 4,038,834 | 8/1977 | Roberts . | |
| 4,369,591 | 1/1983 | Vicino | 52/2.24 X |
| 4,459,714 | 7/1984 | Lin | 5/711 X |
| 4,556,391 | 12/1985 | Tardivel et al. | 52/2.24 X |
| 4,833,813 | 5/1989 | McLemore | 52/2.22 X |
| 5,035,416 | 7/1991 | Burley . | |
| 5,044,030 | 9/1991 | Balton | 5/712 X |
| 5,566,409 | 10/1996 | Klearman | 5/711 X |
| 5,678,357 | 10/1997 | Rubino et al. | 52/2.22 X |
| 5,689,845 | 11/1997 | Sobieralski | 5/654 |

*Primary Examiner*—Robert Canfield
*Attorney, Agent, or Firm*—Vickers, Daniels & Young

[57] ABSTRACT

An inflatable skating rink made up of a plurality of base modules positioned adjacent to one another to define a perimeter of the skating rink. Base modules are made of a flexible material which is substantially impermeable to air. The base modules can be conveniently inflated and deflated. The adjacent base modules include air portals for providing a fluid passageway between the interior of the two adjacently positioned base modules so that the base modules can be mutually inflated and deflated. The adjacent base modules may be connected together in a manner so that they may be separated from one another during disassembly of the skating rink.

108 Claims, 14 Drawing Sheets

INFLATABLE SKATING RINK

The present invention is a continuation-in-part of my U.S. patent application Ser. No. 29/052,897 filed Apr. 8, 1996 which in turn is a continuation-in-part of my U.S. patent application Ser. No. 328,132 filed Oct. 24, 1994, which issued as U.S. Pat. No. 5,555,679 on Sep. 17, 1996, entitled "Inflatable Device".

The present invention relates to the art of inflatable devices and, more particularly, to an U.S. Pat. No. 5,555,679 and U.S. Pat. No. 365,400 and U.S. patent application Ser. No. 29/052,897 filed Apr. 8, 1996 entitled "Inflatable Skating Rink" illustrates inflatable systems of the type to which this invention relates and are incorporated herein by reference.

BACKGROUND OF THE INVENTION

Outdoor sponsored events and activities have gained in popularity over the last several years. During sponsored events activities such as carnivals, fairs, sporting events, trade shows or the like, various areas are partitioned off to define the area for a particular activity or event. Sporting events sponsored by local and/or national advertisers are very common year around. These sponsored activities include basketball, volleyball, tennis, outdoor hockey, etc. Many of these sponsored activities are one or two day events and are commonly situated in a park, in a parking lot, city street, etc. At such events, the event organizer is typically required to assemble additional temporary facilities for the particular sponsored event or events. Typically, metal or wooden fences are temporarily assembled to partition off various areas for the sponsored event. Events such as outdoor hockey require a rink to be set up. Such rinks typically include a metal and wood or a foam and vinyl structure which forms the peripheral boundary of the rink. However, the use of such fences and barriers require a lot of time and manpower to transport, assemble and disassemble such structures. It is not uncommon for an event organizer to spend several days preparing a site for a single day event. Events which require a large structure to be assembled, such as skating rinks for outdoor hockey, require even more time and expense to set up. Although these outdoor sponsored events have become very popular with the public, the complexity and cost of setting up and sponsoring such events has caused many sponsors to limit the number of sponsored events and/or seek other less expensive and complex activities to sponsor.

In view of the high cost and complexity of setting up temporary facilities for outdoor sponsored events, there is developed a need for a device which can be quickly and cost effectively assembled and is versatile enough to be used in a variety of outdoor events.

SUMMARY OF THE INVENTION

The present invention relates to an inflatable device adapted and designed to form a temporary inflatable skating rink. However, the present invention has broader applications and can be used as a wall partition to section off various areas during a sporting event, carnival, convention, etc. and/or can be used to define an area of play for various activities such as football, soccer, baseball, softball, etc. and/or can be used for other activities and events which require the use of a boundary. Historically, inflatable devices were limited to inflatable balloons having a variety of shapes and designs. Such devices were typically limited for advertising purposes or simple amusement rides such as the inflatable moon walk. In U.S. Pat. No. 365,400 and application Ser. No. 328,132 filed Oct. 24, 1994, an inflatable device is illustrated which functions as a bar having a canopy suspended above it. The inflatable bar is versatile enough to also be used as a carnival stand or the like. The present invention expands on the inflatable bar device which as resulted in the development of an inflatable device which is more versatile in use and has a wide variety of applications and functions.

In accordance with the principal feature of the present invention, there is provided an inflatable device which includes an inflatable base module. The base module preferably includes a front and back panel, two side panels and a top and bottom panel; however, it can be appreciated that the base module can include more or less panels. These panels are preferably connected together to limit the amount of fluid leakage from the connected panel edges. The panels can be connected in a number of ways such as by a melted seam, glued edges, stitched edges, laced edges, zipped edges, VELCRO connected edges, snapped or buttoned edges, tongue and groove connected edges, hooked edges, etc. and/or by any combination of these arrangements. At least one air portal is positioned in the side of the base module to form a fluid passageway between the interior of the base module and an adjacently positioned inflatable structure. In the preferred embodiment, the adjacently positioned inflatable module is a second base module. The base module is preferably made up of a flexible and durable material such as materials including coated nylon materials, coated Kevlar materials, or the like. Such materials are ideally flexible, durable, water repellant so as to be inflated and deflated without damage and are durable enough to resist wear and exposure to the element over an extended period of time. As can be appreciated, a wide variety of materials which are flexible and substantially non-permeable to air can used by the present invention.

In accordance with another feature of the present invention, the base module is preferably designed to have a trapezoidal cross-section shape along its vertical axis. Preferably, the base module includes a substantially flat front surface which lies in a plane which is substantially perpendicular to the bottom of the module when the base module is inflated. The top panel and the bottom panel of the base module are substantially rectangular in shape and the top panel has a shorter longitudinal length than the bottom panel. The two side panels of the base module are trapezoidal in shape wherein the top of the side panel has a length which is substantially equal to the longitudinal length of the top panel and the base of the side panel has a length which is substantially equal to the longitudinal length of the bottom section. The back panel of the base module slants downwardly from the back end of the top panel to the back end of the bottom panel. The trapezoidal design of the base module is advantageously designed for use in events wherein the front panel defines the perimeter of an event such as a skating rink. The trapezoidal design has a relatively large surface area at the bottom of the base module. The relatively large bottom section forms a relatively larger frictional area between the bottom of the base module and a surface upon which the base module rests thereby helping to reduce the amount of movement of the base module when an individual bumps into the front face of the base module. The trapezoidal design also transfers the lateral force applied to the base module when an individual bumps into the front panel into a downward force thereby causing the bottom of the base module to compress into the ground thus further helping to maintain the base module in position. As can be appreciated, a variety of other designs may be used for the base module, i.e. cylindrical designs, cubical designs, etc., for use in a variety of other applications.

In accordance with yet another feature of the present invention, a plurality of base modules are connected together to form a wall, boundary, link, enclosure, etc. The sides of the adjacent modules are aligned so that the side air portal between the two base modules are lined up thereby providing a passageway for fluid between the interiors of the base modules. Preferably, the air portal is smaller than the surface area of the side panel thus creating a pressure drop when the fluid passes through the air portal. This type of air portal design facilitates in maintaining the base module in a substantially fully inflated state. Furthermore, the base module resists deflating when one of the sides of the base module is impacted. Furthermore, adjacent base modules are not immediately affected by a sudden pressure change in an adjacent base module. This damping action of pressure differentials between adjacent base modules helps to stabilize and maintain the integrity of the inflatable device. The side air portal is also preferably positioned substantially in the center of the side panel to provide a substantially uniform fluid flow and fluid pressure in adjacent base modules. As can be appreciated, a mesh boundary between two adjacent base modules, which mesh boundary limits the fluid flow through the mesh, may also be used instead of or in combination with the air portal. If a mesh boundary is used, the mesh boundary can make up the complete side panels of the base module or some part thereof.

In accordance with still yet another feature of the present invention, two adjacently positioned base modules share a common side wall and a common air portal. Preferably, such base modules are attached together by stitching the peripheral edges of the side walls together, gluing the edges together, melting the edges together, etc. or some combination thereof. The two base modules form a sectional unit designed to be inflated and deflated together. As can be appreciated, the sectional unit may include two or more base modules connected together. These sectional units are desirable when forming a structure consisting of many adjacently positioned base modules since the use of such sectional units amount of labor and time needed to assemble a large number of base modules to form a particular inflatable device.

In accordance with another aspect of the present invention, two adjacently positioned base modules each have an individual side panel and side air portal. The adjacently positioned side panels of the two base modules can be connected together in a fashion similar to that of base modules sharing a common wall or connected together in a quick connect fashion to help facilitate the connecting and separating of the base modules during assembly and disassembly, respectively. The quick connect for the base modules can include a zipper connection, Velcro connection, button connection, lace connection, snap connection, hook connection, tongue and groove connection, etc., or a combination thereof. The two adjacently positioned air portals are also preferably connected together. Preferably, a quick connection mechanism for the air portals is used when a quick connection mechanism for the side edges of the base modules is used. The quick connection used for the air portals can be the same as used for the side edges of the two adjacently positioned base modules. Preferably, the connection for the air portals is substantially air tight so as to prevent a fluid from escaping the air portals as the fluid passes between the interiors of the two base modules. The connection mechanism which connects the two side edges of the base modules is also designed to inhibit fluid from escaping thereby providing a second barrier to any fluid which penetrates two air portals. Such a design helps to insure the proper inflation of the adjacently positioned base modules. Base modules having an individual side panel and side air port are preferably positioned at each end of a section unit of base modules. Such a design provides for the easy connection of a number of sectional units together.

In accordance with yet another aspect of the present invention, the base module includes a blower port which provides a fluid passageway from a blower to the interior of the base module thereby providing for the a blower to inflate the base module. Preferably, the blower portal is positioned on the back panel of the base module. The cross-sectional area of the blower portal is designed to be preferably less than the surface area of the back panel of the base module. The connection of the blower attachment to the blower portal is preferably a quick connect arrangement such as a zipper, Velcro, buttons, lace, snaps, etc., to allow the blower to be easily connected and disconnected from the base module.

In accordance with still yet another aspect of the present invention, the base module includes an inflatable base guard which is attached to the bottom of the front panel of the base module. The inflatable base guard is designed to protect the bottom of the base module and to prevent objects such as a hockey puck, soccer ball, baseball and other types of objects from rolling under or becoming wedged under the bottom panel of the base module. The inflatable base guard is preferably made up of a material similar to the material used to make the panels of the base module. The inflatable base guard is preferably connected to the base module in such a manner that the inflatable base guard is in fluid communication with the interior of the base module. This arrangement provides for the simultaneous inflation and deflation of the base module and the inflatable base guard. At least one air portal, an air permeable mesh or the like may be used to provide a passageway for the fluid between the interior of the base module and the inflatable base guard.

In accordance with another aspect of the present invention, the base module includes an air vacating arrangement which provides for quick deflation of the base module when the base module is being disassembled after use. The air vacating mechanism is also preferably designed to also allow access to the interior of the base module for purposes of repair, assembly, disassembly, insertion of weights, etc. Preferably, the air vacating mechanism is located on the back panel of the base module. A preferable design of the vacating mechanism is the inclusion of a zipper along the complete length of the back panel of the base module. The zipper is designed to provide easy access to the interior of the base module and is further designed to be quickly and easily closed so as to form a seal which inhibits the flow of fluid through the seal. As can be appreciated, other mechanisms can be incorporated onto the base module which can be easily opened and shut and provide a substantially air tight seal.

In accordance with yet another aspect of the present invention, the base module includes an inflatable pillar which is connected to the top of the base module. The inflatable pillar is designed to extend upwardly from the top panel of the base module. Preferably, the inflatable pillar has a substantially uniform cross-sectional area throughout its longitudinal length. Furthermore, the cross-sectional shape of the pillar is preferably similar in shape to the cross-sectional shape of the top panel of the base module. The inflatable pillar is preferably connected to the base module about its peripheral edge so as to maximize the stability of the pillar on the top panel of the base module. The inflatable pillar may be connected by stitching, melted seam, glue or the like or combinations thereof to permanently affix the inflatable pillar to the top of the base module. Alternatively, the inflatable pillar may be connected by a quick connection such as a zipper connection, Velcro connection, lace connection, button connection, snap connection, tongue and groove connection, etc. so that the inflatable pillar may be removed from the top panel of the base section as needed. Preferably, the base of the inflatable pillar is formed by the top panel of the base module; however, a separate base may be incorporated in the inflatable pillar. The top panel of the base module preferably includes an air portal and/or air permeable mesh to provide a fluid passageway between the interior of the base module and the interior of the inflatable pillar so that the base module and inflatable pillar can be simultaneously inflated and deflated. If an air portal is used, the air portal in the top panel of the base module preferably has a cross-sectional area which is less than the surface area of the top panel so as to create a pressure drop for fluid passing between the inflatable pillar and the base module. This air portal design helps to insure that the base module and inflatable pillar remain inflated and helps resist the deformation of the base module and/or pillar when bumped into. Preferably, the air portal for the pillar is located at or near the center of the top panel of the base module so that the inflatable pillar has a substantially uniform pressure throughout the pillar. If a mesh boundary is used, the mesh boundary can make up the complete top panel of the base module or some part thereof. If the inflatable pillar includes a separate base, the base is preferably, stitched, glued and seam melted to the bottom edges of the inflatable pillar and includes an air portal which is substantially aligned with the air portal in the top panel of the base module. In addition, a connection arrangement is provided to connect the air portal in the base of the inflatable pillar to the air portal in the top panel to insure that essentially all the fluid passing between the portals passes between the interior of the inflatable pillar and the interior of the base module. The pillar connection between the peripheral edge of the base of the pillar and the edge of the top panel of the base module provides a secondary seal to prevent fluid has escaped from the air portal. Alternatively, the base of the pillar can include a mesh boundary which is easily aligned with the air portal and/or mesh region in the top panel of the base module. The inflatable pillar may also include an air vacating arrangement to provide for the quick deflation of the inflatable pillar during disassembly and/or to provide easy access into the interior of the inflatable pillar. Preferably, the air vacating arrangement is positioned along the longitudinal length of the back section of the inflatable pillar. The inflatable pillar may also include a connecting mechanism such as a zipper and/or clip ring positioned on the front and/or front edges of the pillar to attach banners, netting, ropes or the like to the inflatable pillar.

In accordance with still yet another aspect of the present invention, there is provided a pole support in the base module for supporting and securing a pole to the base module. Preferably, the pole support includes a pole opening in the top panel of the base module. The pole opening preferably has a cross-sectional shape which is substantially the same as the cross-sectional shape of the pole and is sized to be slightly larger than the pole so the pole may be inserted through the pole opening. The pole support also preferably includes a sealing mechanism to prevent fluid in the interior of the base module from escaping through the pole opening. Preferably, the pole support also includes a pole sleeve which extends from the pole opening into the interior of the base module and may be secured to the bottom panel of the base module. The pole sleeve is preferably made up of a material which is substantially impermeable to air and is secured to the peripheral edge of the pole opening in a substantially air impermeable manner. The pole sleeve may also includes a bottom section. Preferably, the pole sleeve is connected to the bottom panel of the base module and shares a common bottom with the base module. Alternatively, the base of the pole sleeve may be made up of a resilient material such as hard plastic, rubber, metal or the like designed or such material may be sewn to the bottom panel of the base module to support the weight of the pole and to resist damage from the base of the pole.

In accordance with another aspect of the present invention, the inflatable device includes a base module having an inflatable door connected to the side of the base module. The inflatable door is preferably designed to be in fluid communication with the interior of the base module so that the inflatable door and base module can be simultaneously inflated and deflated. The inflatable door preferably includes one or more air portals in the side of the inflatable door which are aligned with corresponding air portals in the side panel of the base module. These air portals provide for a fluid passageway between the interior of the base module to the interior of the inflatable door. Alternatively, mesh boundary can be used instead of air portals or in combination with air portals to provide a fluid passageway between the base module and door. The inflatable door may also include an interior partition which divides the inflatable door in two or more inner sections. Preferably, the partition includes an air portal which is sized to insure that the inflatable door remains inflated during operation. Preferably the side panel of the base module includes a door strip which re-enforces the area where the inflatable door attaches to the side panel. The door strip is preferably made up of a material similar to that of the side panel or may be made up of a resilient material such as plastic, metal or the like.

In accordance with yet another aspect of the present invention, the inflatable device includes a base module having an inflatable platform which is connected to the base module. Preferably, the platform is connected to the bottom side of the base module such as by an air portal and/or mesh boundary and the interior of the platform is in fluid communication with the interior of the base module thereby providing for the simultaneous inflation and deflation of the base module and platform. The platform is preferably made of a material which is similar to the material making up the panels of the base module. The platform may also include an inflatable base guard attached to the front of the platform which is similar in design and shape to the base guard attached to the front panel of the base module. The base guard is designed to perform substantially the identical function as the base guard of the base module. The inflatable platform preferably includes an interior partition which divides the interior of the platform into two sections. The partition may include an air portal having a cross-sectional area which is less than the surface area of the partition. The design of the air portal in the platform insures that the platform is properly inflated during inflation. Alternatively, a mesh boundary can be used or a mesh boundary and air portal design can be used to provide proper inflation of the platform. A platform cover may be incorporated on the platform and is designed to cover the top surface of the platform to protect the top surface from being inadvertently punctured, or ruptured during use. The protective covering may include made of a material substantially the same as the material used to make the inflatable platform or may be some other material which is resilient to wear and puncturing.

In accordance with another aspect of the present invention, net sections are connected to the poles and/or inflatable pillars to provide a screen. Such a screen is desired when the inflatable base modules are arranged for use in sporting events such as soccer, hockey, etc. The screen is used to help prevent a ball or puck from leaving the field of play during an event. The screen also allows spectators to watch an event taking place inside the inflatable structure. The net sections can be sewn onto the poles and pillars or designed to be easily attached by a zipper, buttons, lace, Velcro or the like. To maintain tension at the top of the net sections, a rope or metal cord may be used which is strung between the top of the pillars and the poles to prevent the sagging of the net sections between the pillars and the poles.

The primary object of the present invention is to provide an inflatable device which can be used to partition off a desired area and which can be quickly assembled and disassembled.

Another object of the present invention is to provide an inflatable device which can be formed into a rink for use in hockey events or the like.

Yet another object of the present invention is to provide an inflatable device which is modular in design and can be easily assembled together to form a desired inflatable structure.

Still yet another object of the present invention is to provide an inflatable device which is in air communication with adjacent modular devices for simultaneous inflation and deflation of the adjacent modular devices.

Another object of the present invention is to provide an inflatable device wherein the modular components incorporate a design which reduces the frequency of objects becoming lodged under the bottom of the inflatable device.

Yet another object of the present invention is to provide an inflatable device having an air vacating arrangement for quickly deflating the device.

Still yet another object of the present invention is to provide an inflatable device having one or more of the base modules with an inflatable pillar designed to support a net, banner or the like.

Another object of the present invention is provided an inflatable device having a base module with a pole support which pole support is designed to support a pole for supporting a banner, netting or the like.

Yet another object of the present invention is to provide an inflatable device including one or more inflatable doors.

Still yet another object of the present invention is provided an inflatable device including an inflatable platform connected to an inflatable base module for providing a platform region beneath the inflatable doors of the inflatable device.

Another object of the present invention is to provide an inflatable device made of air impermeable materials which are flexible and resistant to wear.

Yet another object of the present invention is to provide an inflatable device which includes interior partitions to insure the proper inflation of the device components.

Still yet another object of the present invention is to provide an inflatable device which quickly dampens localized pressure differentials.

Another object of the present invention is to provide an inflatable device which resists moving when impacted.

Yet another object of the present invention is to provide an inflatable device including a blower used to inflate one or more components of the device.

These and other objects and advantages will become apparent to those skilled in the art upon reading and following the description taken together with the accompanied drawings.

BRIEF DESCRIPTION OF THE DRAWINGS

Reference may now be made to the drawings which illustrate various preferred embodiments that the invention may take in physical form and in certain parts and arrangement of parts wherein.

DETAILED DESCRIPTION OF THE PREFERRED EMBODIMENT

Figure 1:
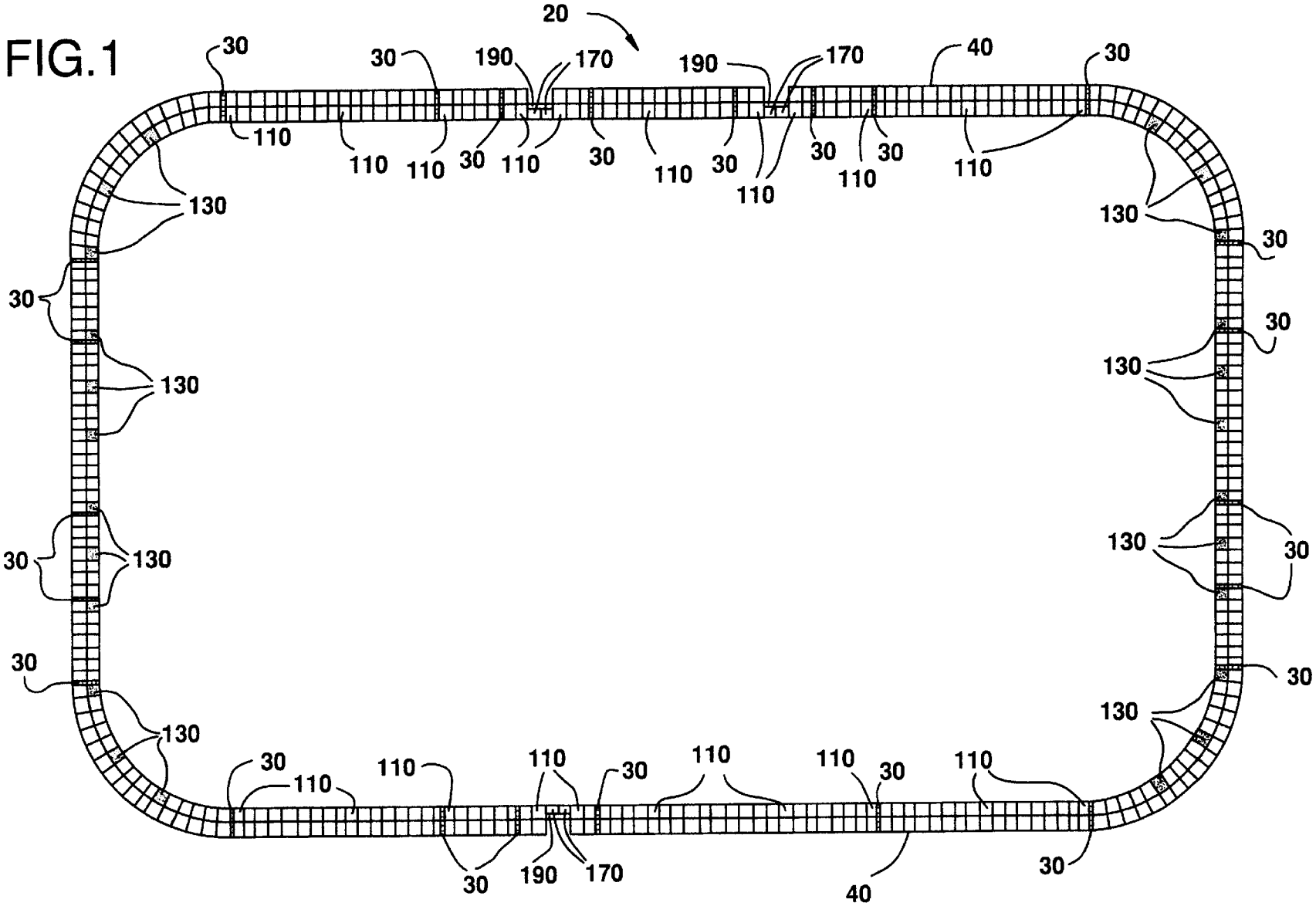
FIG. 1 is a top view of a skating rink illustrating the various modular components of the skating rink.

Referring now to the drawings, wherein the showings are for the purpose of illustrating the preferred embodiments of the invention only and not for the purpose of limiting the same, in FIG. 1 there is shown a schematic view of an inflatable skating rink 20 in accordance with the present invention. Inflatable skating rink 20 is made up of a plurality of section units connected together by zipper joints 30. The sectional units are made up of a plurality of inflatable structures such as a plurality of base modules 40. The basic form of the base modules which form the sectional units are best illustrated in FIGS. 2 and 3 and modifications of the base modules are illustrated in FIGS. 4–9.

Figure 2:
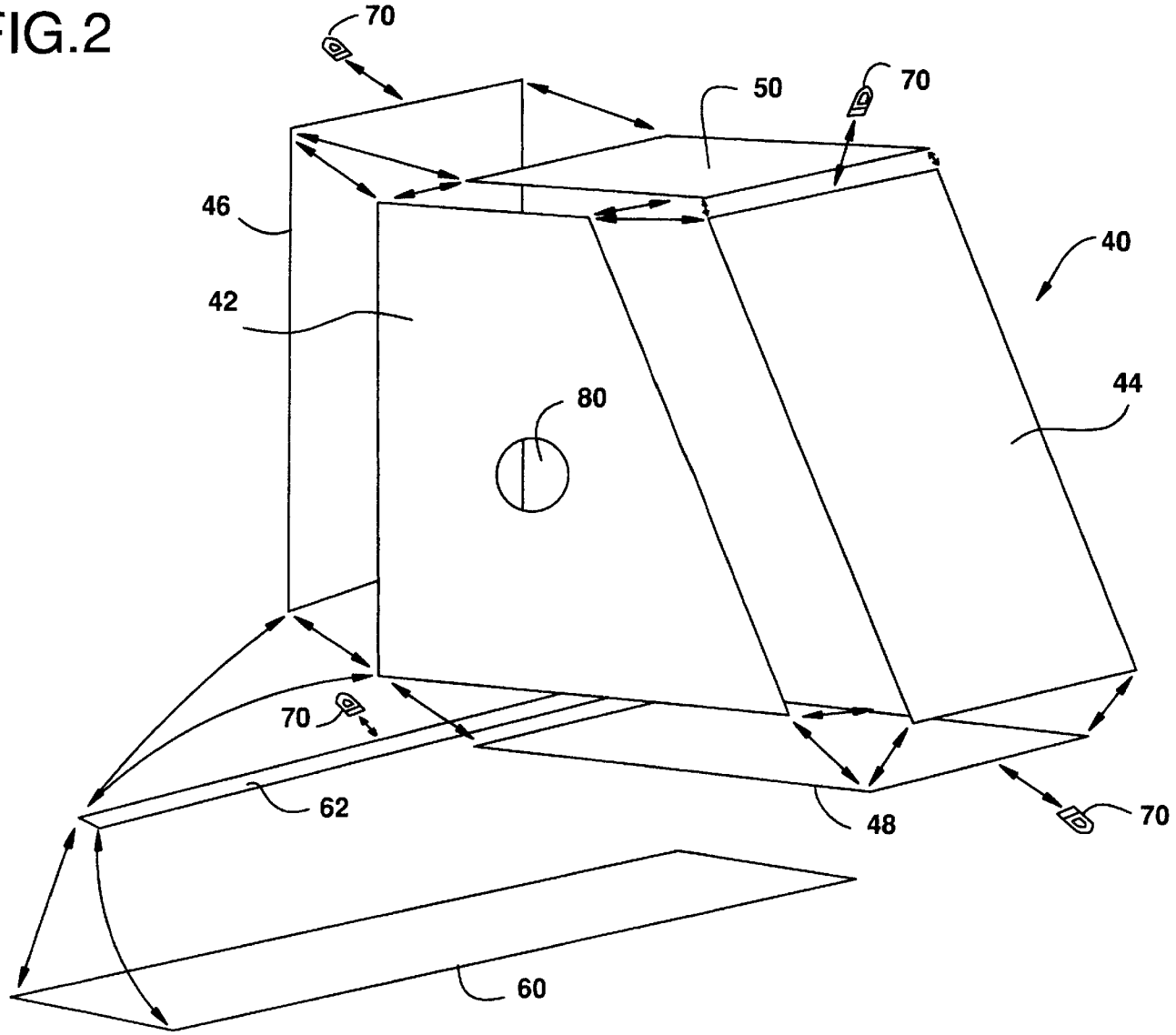
FIG. 2 is an exploded plane view of the base module of the present invention showing a flat front face of the base module.
Figure 3:
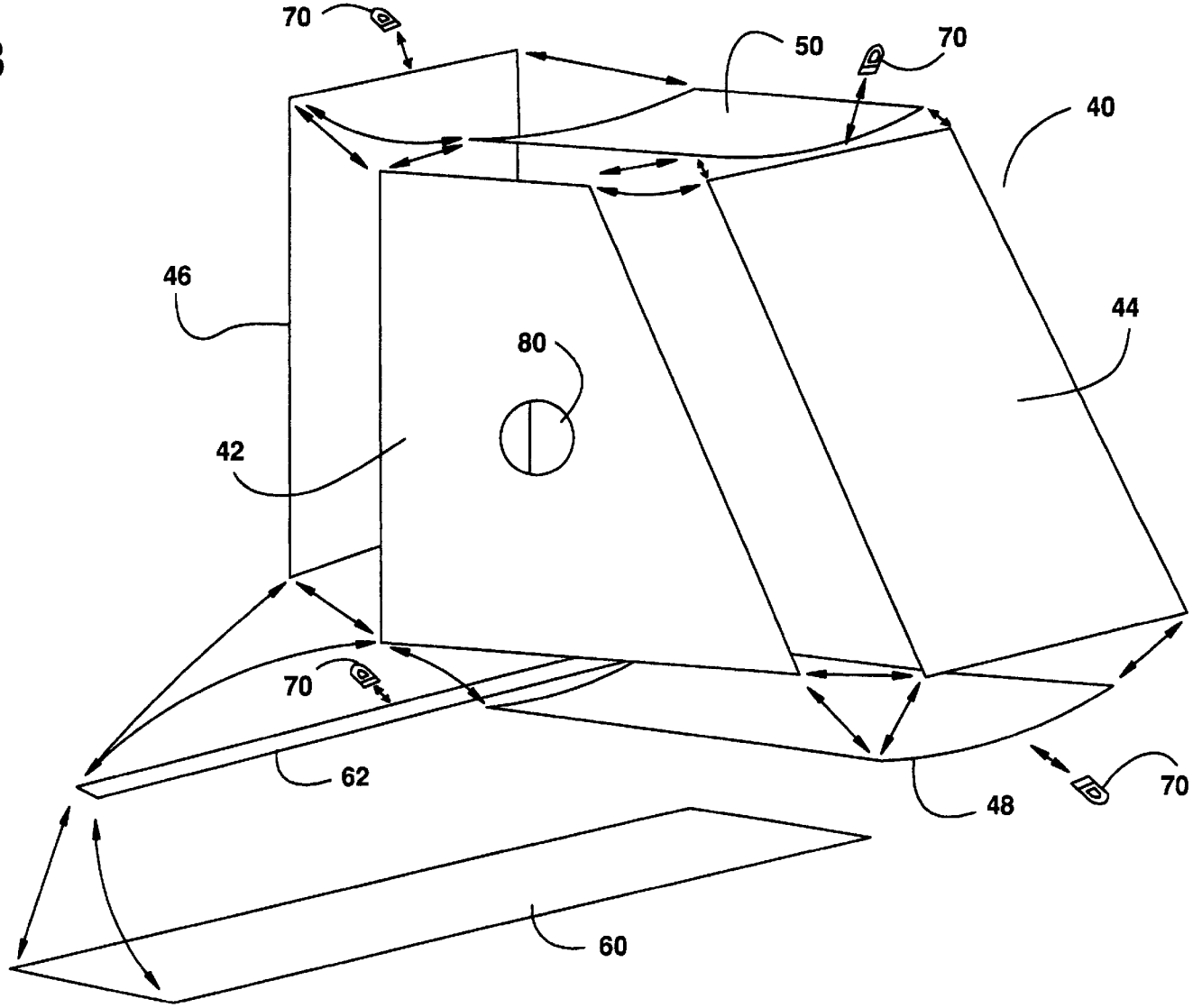
FIG. 3 is an exploded plane view of the base module of the present invention showing a curved front face of the base module.
Figure 13:
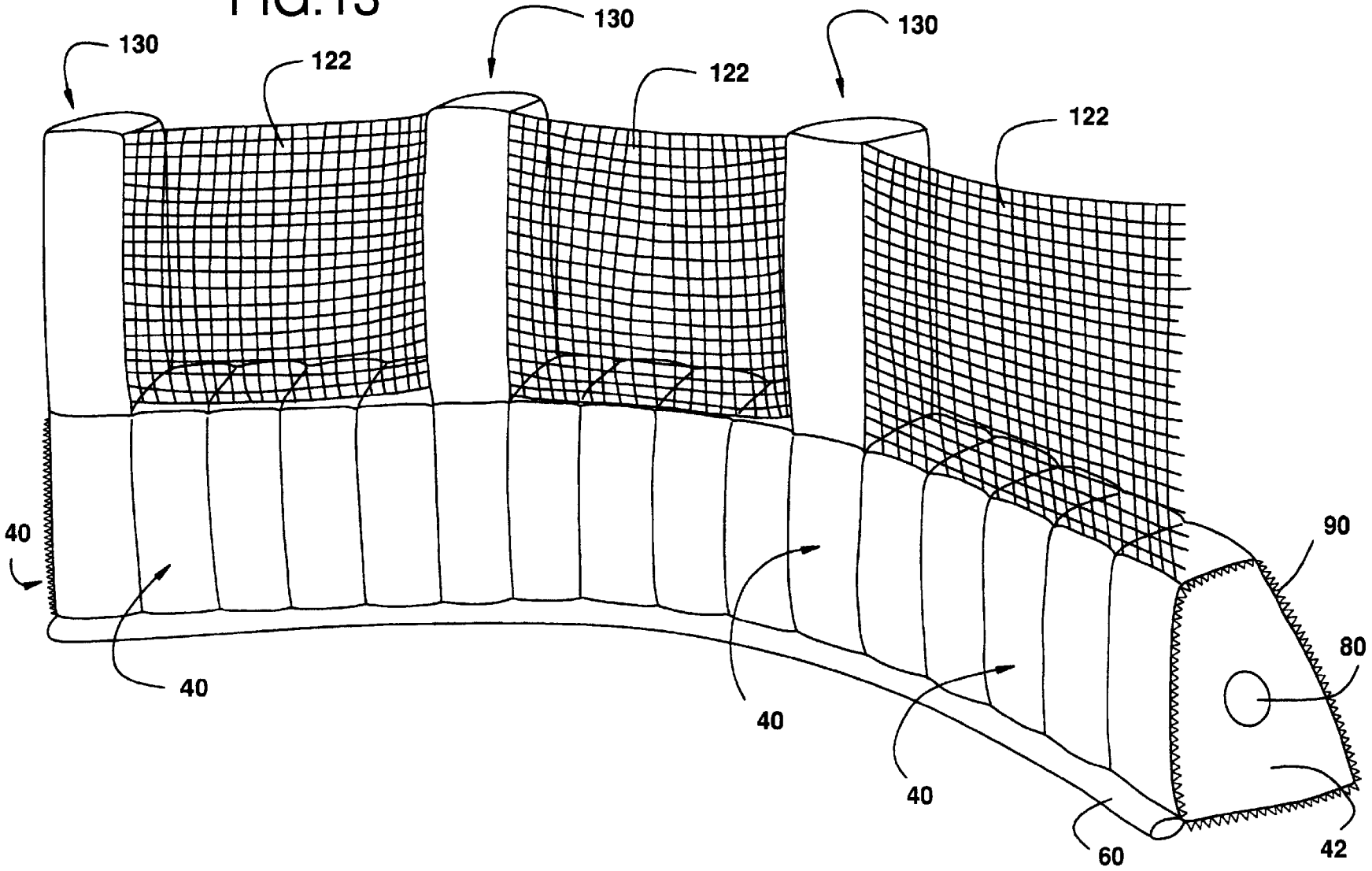
FIG. 13 is a plane view of an inflatable modular section illustrating a plurality of base modules connected together and including a plurality of inflatable pillars supporting a netting arrangement between the inflatable pillars; and, FIG. 14 is a plane view of an inflatable modular section illustrating a net support arrangement.

Referring now to FIGS. 2 and 3, base modules 40 includes a front panel 46, two side panels 42, a back panel 44, a top panel 50 and a bottom panel 48. These panels are preferably made up of a flexible and durable material which is substantially air impermeable. One such material which has been successfully used is vinyl coated nylon. The panels of the base module 40 are connected together to create a substantially air tight connection between the edges of the panels. Preferably, the panel edges are stitched together. Base module 40 also includes a base guard 60 which is connected to a guard strip 62. Guard strip 62 is in turn connected to the bottom edge of front panel 46 and the front edge of bottom panel 48. Guard strip 62 is a mesh material which allows a fluid such as air to pass through the guard strip thereby providing for the mutual inflation and deflation of all the components of the base module. An inflated base guard is illustrated in FIG. 13. As illustrated in FIGS. 2 and 3, base guard 60 has a length which is greater than the width of the base module 40. The length of base guard 60 is selected so that the base guard can be attached to a plurality of base modules. Preferably, three base modules can be attached to a single base guard; however, the length of the base guard can be adjusted so as to be attached to one or more base modules. Base module 40 preferably includes one or more clip tabs 70 which are sewn into the seams of the base module. These clip tabs may be used to secure banners and/or netting to the base module and to further anchor the base module in a particular position. Although not shown, one or more clip tabs is preferably positioned on the base of the module for use in anchoring the base module in place such as by a stake or the like.

At least one of the side panels 42 include a side air portal 80. Preferably, each side panel includes a side air portal 80. The air portal is preferably positioned in the center of side panel 42 and has a surface area which is substantially less than the surface area of the side panel. Preferably the size of air portal 80 is less than 20% of the surface area of the side panel and is more preferably about 2–12% of the surface area of the side panel.

The shape of the base module 40 is preferably trapezoidal in shape. Since such a design of the base module is highly advantageous for a skating rink, however, the design of the base module may be altered for use in other applications. The base module illustrated in FIG. 2 is designed to be used in the straight section units of the inflatable skating rink and the base module illustrated in FIG. 3 is designed to be used in the curved section units of the skating rink. The top and bottom panels of the base modules in FIGS. 2 and 3 are designed accordingly in conjunction with the other components of the base module so that the base module can be properly positioned in the skating rink structure. The straight and curved sectional units which make up the skating rink are illustrated in FIG. 1. These sectional units are attached together by a zipper joint 30 and are arranged to form the inflatable skating rink. Although not shown, the zippers preferably include a flap arrangement in the inner sides of the zipper which overlaps when the zipper is closed. The flap arrangement helps to prevent air from passing through the zipper. It will be appreciated that the sectional units can be assembled in a variety of other ways to form other structures. By providing the base modules in sectional units, the assembly of the inflatable skating rink 20 is significantly simplified. Preferably, an official size skating rink is made up of 4–12 modules. More or less modules can be used changing the size of the skating rink.

Figure 4:
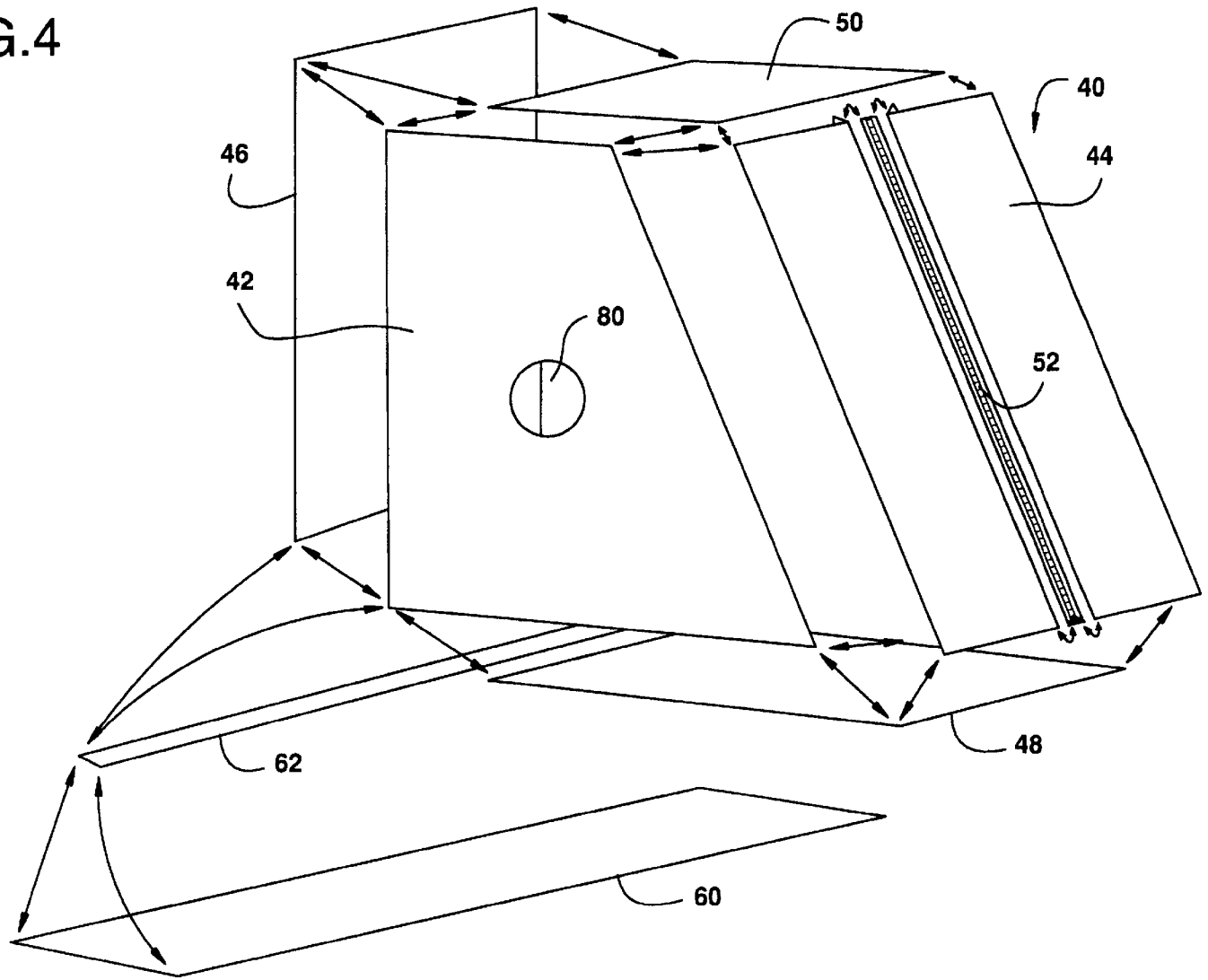
FIG. 4 is an exploded plane view of the base module of FIG. 1 illustrating an air vacating mechanism attached to the rear panel of the base module.

Referring now to FIG. 4, another embodiment of the invention is illustrated whereby base module 40 is modified to include a vacating zipper 52 positioned along the longitudinal length of back panel 44. Vacating zipper 52 is preferably positioned in the middle of back panel 44 and is designed to provide access to the interior of base module 40. When deflating the inflatable skating rink, the vacating zipper is opened to provide for the quick deflation of the inflatable skating rink. The vacating zipper also provides access to the interior of the base module for assembly and repair of the inflatable skating rink. The vacating zipper also allows for weighted devices such as sand bags, rocks, canisters filled with water or shot, etc. to be placed in the interior of base module 40 to secure the base module in position when in use. The vacating zipper preferably forms a seal which inhibits the flow of fluid through the seal when the zipper is closed thereby allowing the base module to properly inflate. A flap arrangement on the zipper, similar in design to the flap arrangement for zipper joint 30, can be used to provide better sealing of the zipper. At least one vacating zipper is preferably included in a section unit of base module for easy deflation of the sectional unit.

Figure 5:
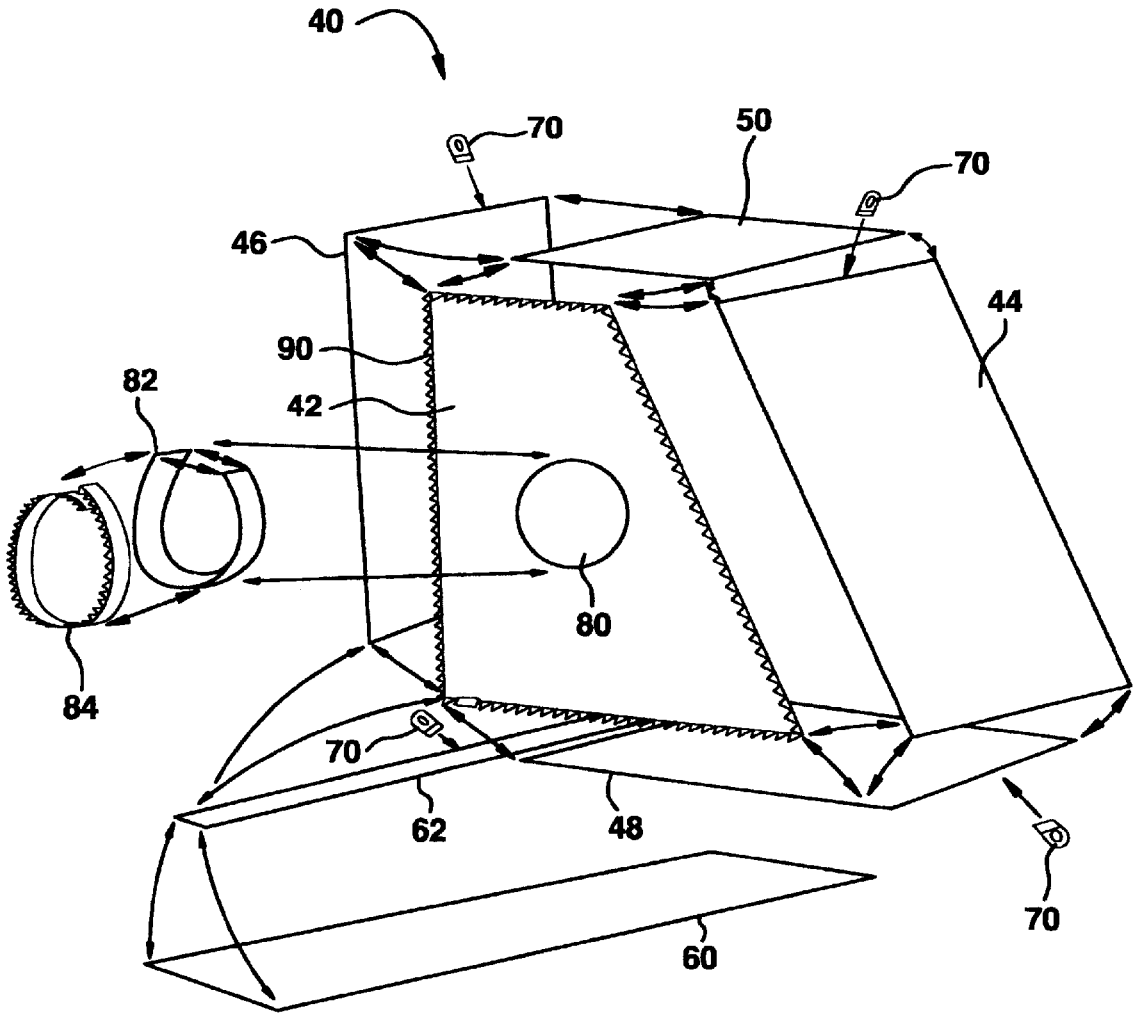
FIG. 5 is an exploded plane view of the base module of FIG. 1 illustrating a side connection mechanism on the side of the base module for connecting together two adjacent base modules and two adjacent air portals.

Referring now to FIG. 5, yet another embodiment of the invention is illustrated whereby base module 40 includes a side zipper 90 positioned on the peripheral edge of side panel 42. Side zipper 90 is designed to be attached to a corresponding zipper located on an adjacent base module 40 to form a zipper joint 30 as shown on FIG. 1. The sectional units of the base modules preferably include a base module at each end of the sectional unit which includes a side zipper 90. A sectional unit having an end base module which includes side zipper 90 is illustrated in FIG. 13. Side panel 42 further includes a portal zipper 84 which is connected to a zipper strip 82 which in turn is connected to the peripheral edge of air portal 80. Portal zipper 84 is designed to be connected to a portal zipper located on an adjacently positioned base module. Portal zippers of adjacently positioned base modules are designed to form a substantially fluid impermeable connection. Furthermore, the zipper joint 30 which is formed by side zippers 90 on adjacently positioned base modules forms a secondary seal which helps prevent fluid from escaping from the base modules.

Figure 6:
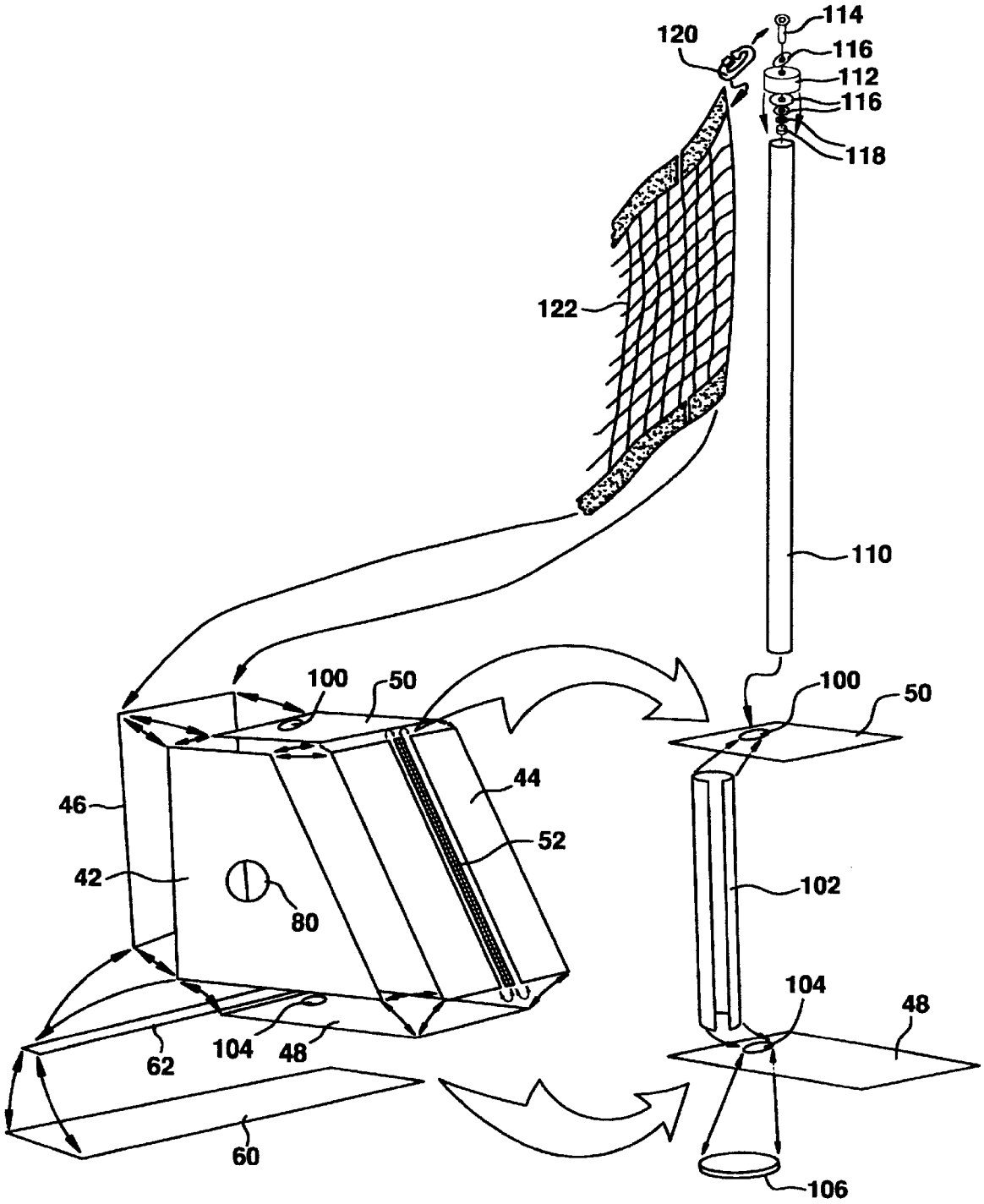
FIG. 6 is an exploded plane view of the modular base component of FIG. 4 illustrating a modified design for incorporating a pole support in the modular section.

Referring now to FIG. 6, another embodiment of the invention is illustrated thereby base module 40 is modified to support a pole. The pole 110 is an elongated cylindrical structure designed to fit into top opening 100 of top panel 50. The pole may be made of light weight materials such as a light weight metal or plastic. The pole preferably includes a pole cap 112 which is inserted over the top of pole 110. The pole cap includes a hole in the center of the cap to receive an eye screw 114. The eye screw is connected to the pole cap by one or more washers 116 and nuts 118. Eye screw 114 is designed to receive a pole clip 120 or net cable 162 which in turn connects to a net 122.

Pole 110 is supported in an upright position in base module 40 by passing the bottom end of pole 110 through top opening 100 and into pole sleeve 102. Pole sleeve 102 is connected about the interior peripheral edge of top opening 100 and the peripheral edge of bottom opening 104 in bottom panel 48. When base module 40 is inflated, pole sleeve 102 is rigidly secured between top panel 50 and bottom panel 48 and functions to maintain pole 110 in an upright position. The top opening is positioned in the top and bottom panel respectively so as to be in substantially longitudinal alignment when the base module is inflated. Such an arrangement causes the pole sleeve to lie in a plane substantially perpendicular to the bottom panel thereby facilitating in the upright positioning of pole 110 when inserted into the base module. Pole sleeve 102 is preferably made up of a urethane material which provides for easy insertion of the pole into the sleeve. However, the pole sleeve may be made of other materials such as the same material used to make the panels of the base modules. Pole sleeve 102 is stitched to both the top hole opening 100 and module bottom 48 so as to minimize the amount of air which escapes from the interior of the base module through the top opening and bottom opening. A bottom cap 106 is attached to module bottom 48 at position 104 to support the weight of pole 110 when inserted into the base module. Bottom cap 106 is preferably made up of a resilient material such as hard rubber, plastic or metal or may be made up of some other materials such as the material of the panels of the base module. As shown in FIG. 6, the base module 40 includes a vacating zipper 52 positioned on back panel 44 of the base module. As can be appreciated, the incorporation of the vacating zipper in the base module may be eliminated.

Figure 7:
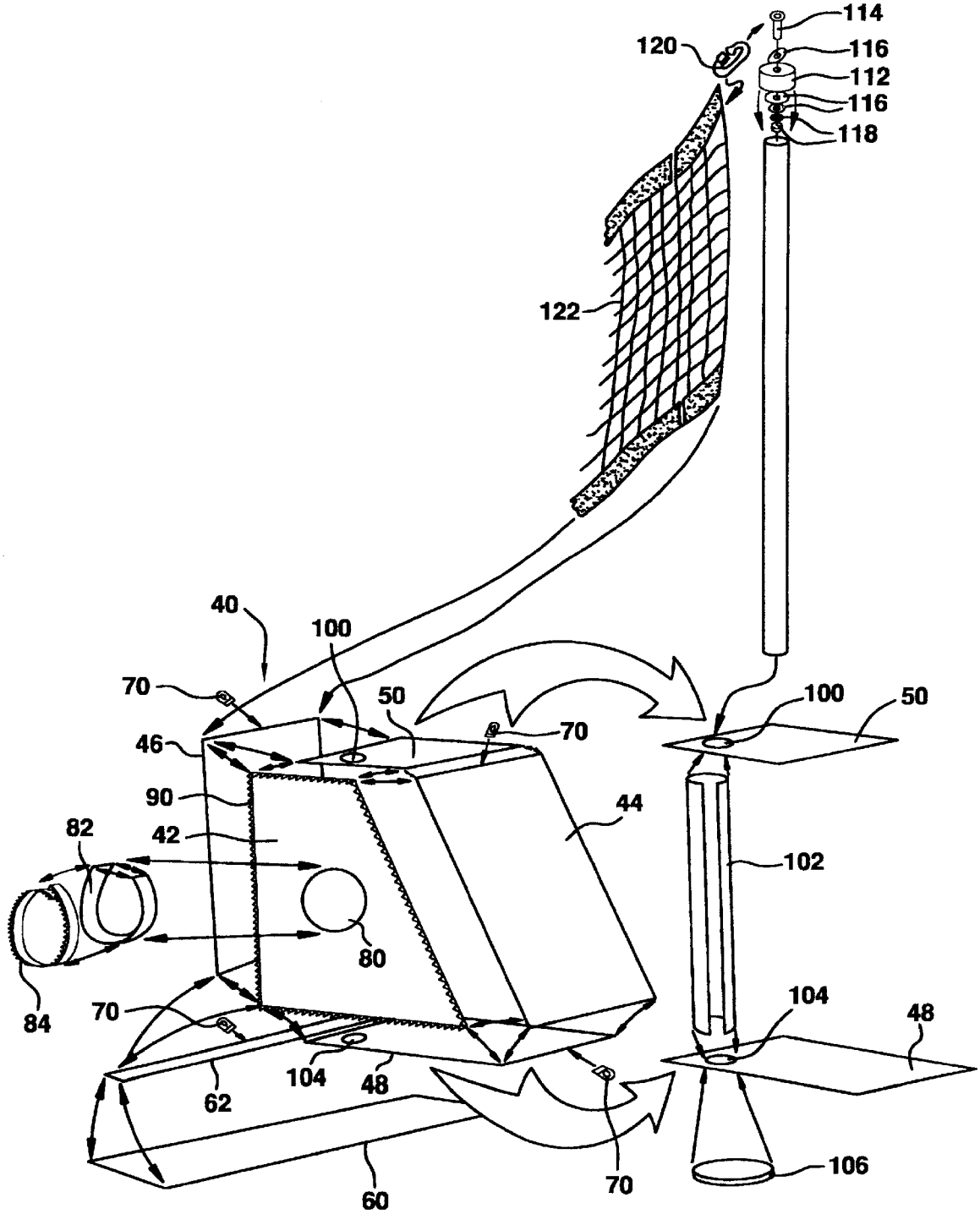
FIG. 7 is an exploded plane view of the base module disclosed in FIG. 6 illustrating a side connection mechanism on the side of the base module for connecting together two base modules and two adjacent air portals.
Figure 14:
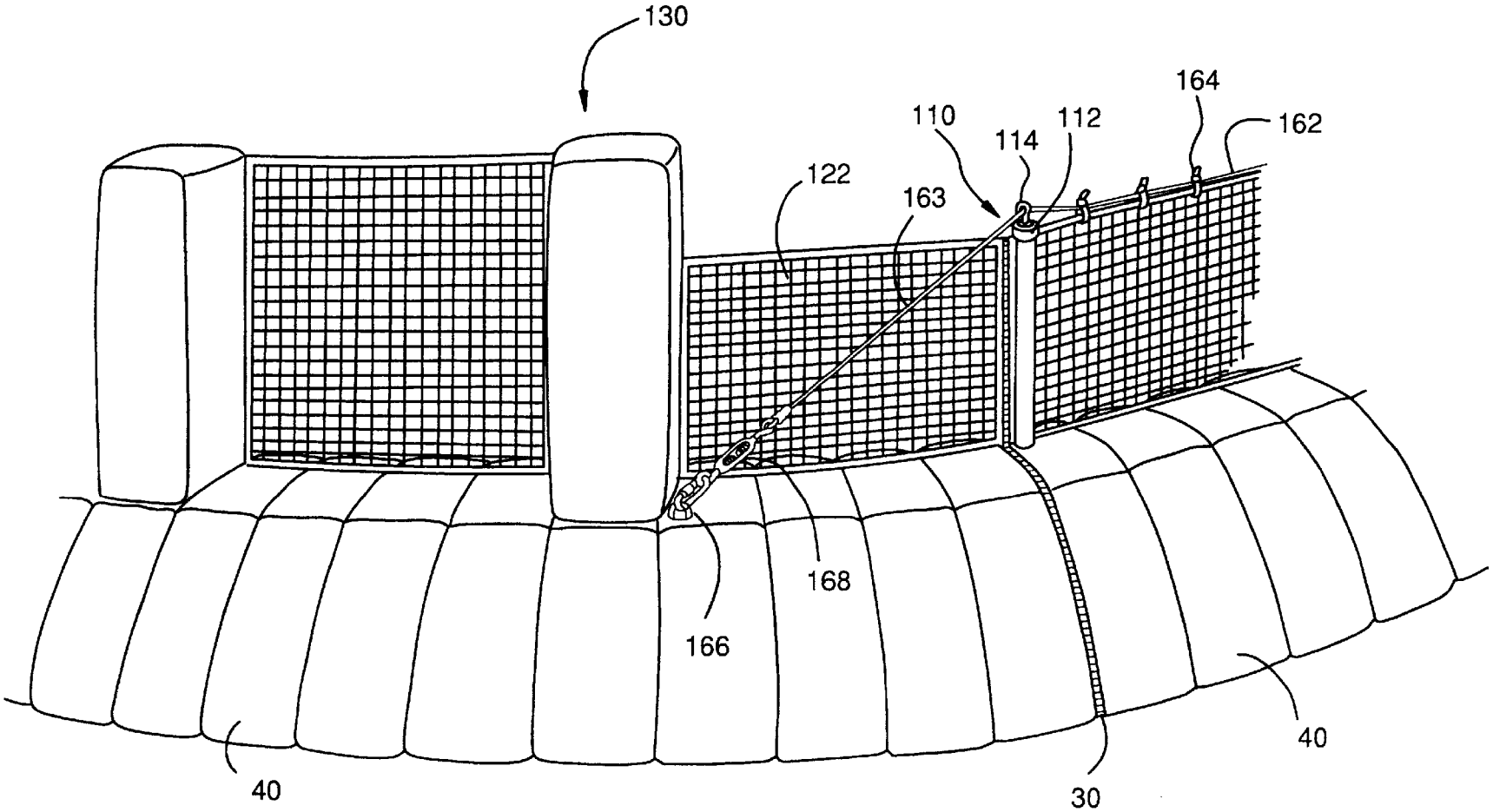

FIG. 7 is a further modification of the base module illustrated in FIG. 6. The base module is shown to include a side zipper 90 connected to the peripheral edge of side panel 42 and a portal zipper 84 and a zipper strip 82 connected to air portal 80 positioned on side panel 42. As illustrated in FIG. 1, the base modules which have been modified to support pole 110 are positioned in a space relation along the two sides of the inflatable skating rink. The poles are designed to support a net 122 along the sides of the skating rink. The netting is designed to prevent a hockey puck from escaping the boundaries of the inflatable rink. The base of the net 12 may be connected to the base modules by clip tap 70 or may be attached by a zipper to the top front end of the base module, not shown, or by some other mechanism. Top opening 100 and bottom opening 104 are positioned near the front end of the top and bottom panel so that the netting can be conveniently connected to the top front end of the base module. As illustrated in FIG. 14, the top of net 122 is preferably secured to the top of pole 110 and net cable 162. The net is connected to the net cable by cable straps 164. This arrangement prevents the net from sagging between poles 110. Net cable 162 is maintained in tension by connecting each end of the cable to a base module or pillar at cable connector tab 166. Cable connector tab is preferably sewn onto the base module or pillar. A cable tensioner 168 is turned until the net cable is at the desired tension. Net cable 162 is strung between poles 110 by passing the cable through the eye screw 114 of pole of pole cap 112. As can be appreciated, the net cable can be strung between pillars 130 to prevent sagging of net 122 between the pillars.

Figure 8:
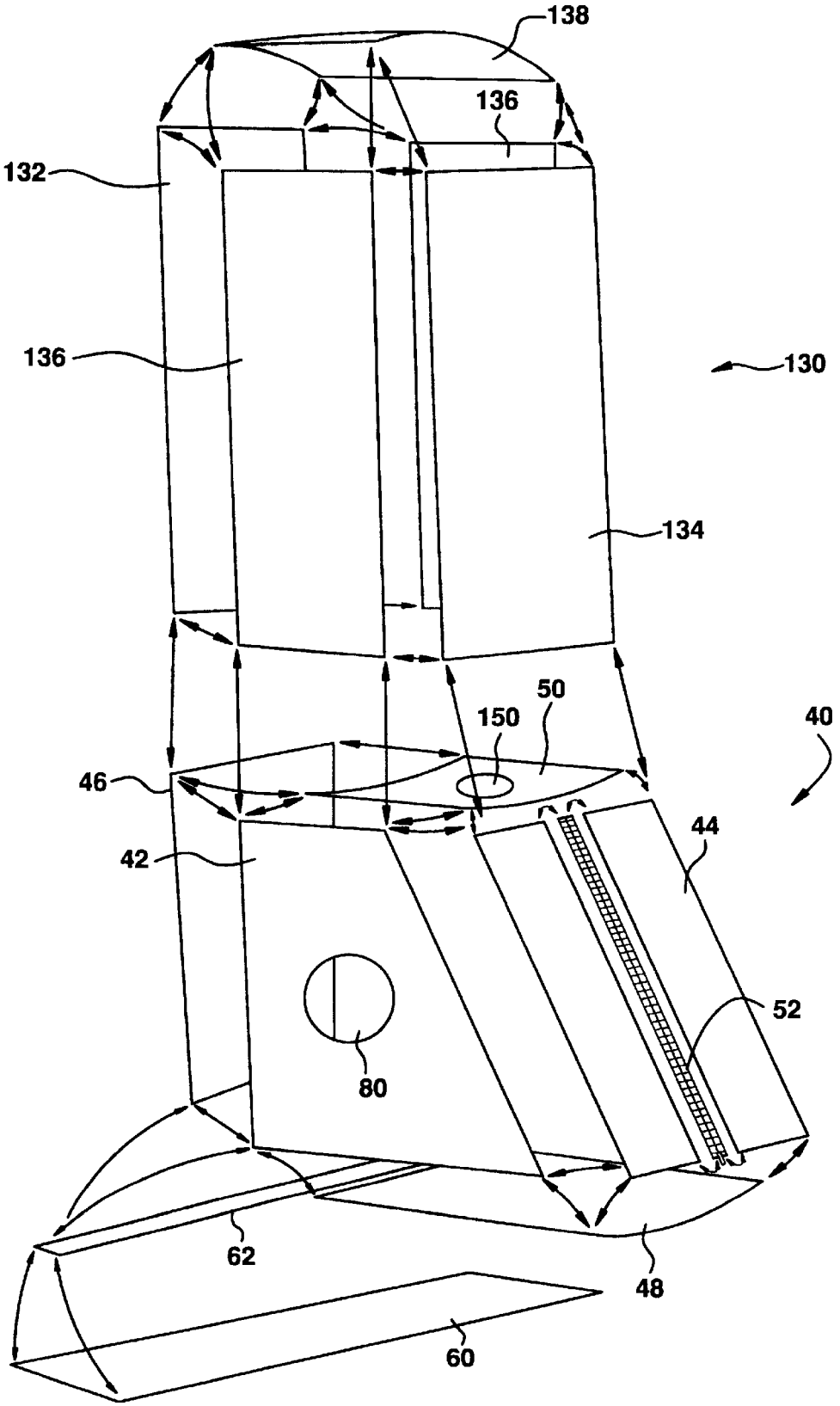
FIG. 8 is an exploded plane view of the base module of FIG. 1 illustrating an inflatable pillar attached to the top of the base module.

Referring now to FIG. 8, yet another embodiment of the invention is illustrated whereby base module 40 includes an inflatable pillar 130 attached to the top panel 50 of the base module. Pillar 130 includes a front panel 132, back panel 134, two side panels 136, and a top panel 138. The material for the pillar preferably the same material used to make the base modules. Pillar 130 is preferably designed to have a similar cross-sectional shape as the cross-sectional shape of top panel 50 of the base module. As shown in FIG. 8, top panel 50 of base module 40 functions as the base of pillar 130. The panels of the pillar are stitched together in a similar fashion as the panels of base module 40 to minimize the leakage of fluid from the panels. The bottom of the front, back and side panels of pillar 130 are stitched to the peripheral edge of top panel 50 thereby securing the pillar to the top of base module 40. Top panel 50 is modified to include an air portal 150 to provide fluid communication between the interior of the base module and the interior of the pillar. Such an air portal design provides for the mutual inflation and deflation of the base module and pillar. Preferably, the air portal is positioned substantially at the center of top panel 50 so as to provide a substantially uniform pressure within pillar 130. The size of air portal 150 is preferably less than 20% of the surface area of top panel 50 and more preferably about 2–12% of the surface area of the top panel. The base module of FIG. 8 is shown to include a vacating zipper 52 to provide for the quick deflation of the base module 40 and pillar 130 and to allow weighted objects to be placed into the interior of base module 40 to maintain the inflated base module and inflated pillar in place. However, it can be appreciated that the base module may not include a vacating zipper.

Figure 9:
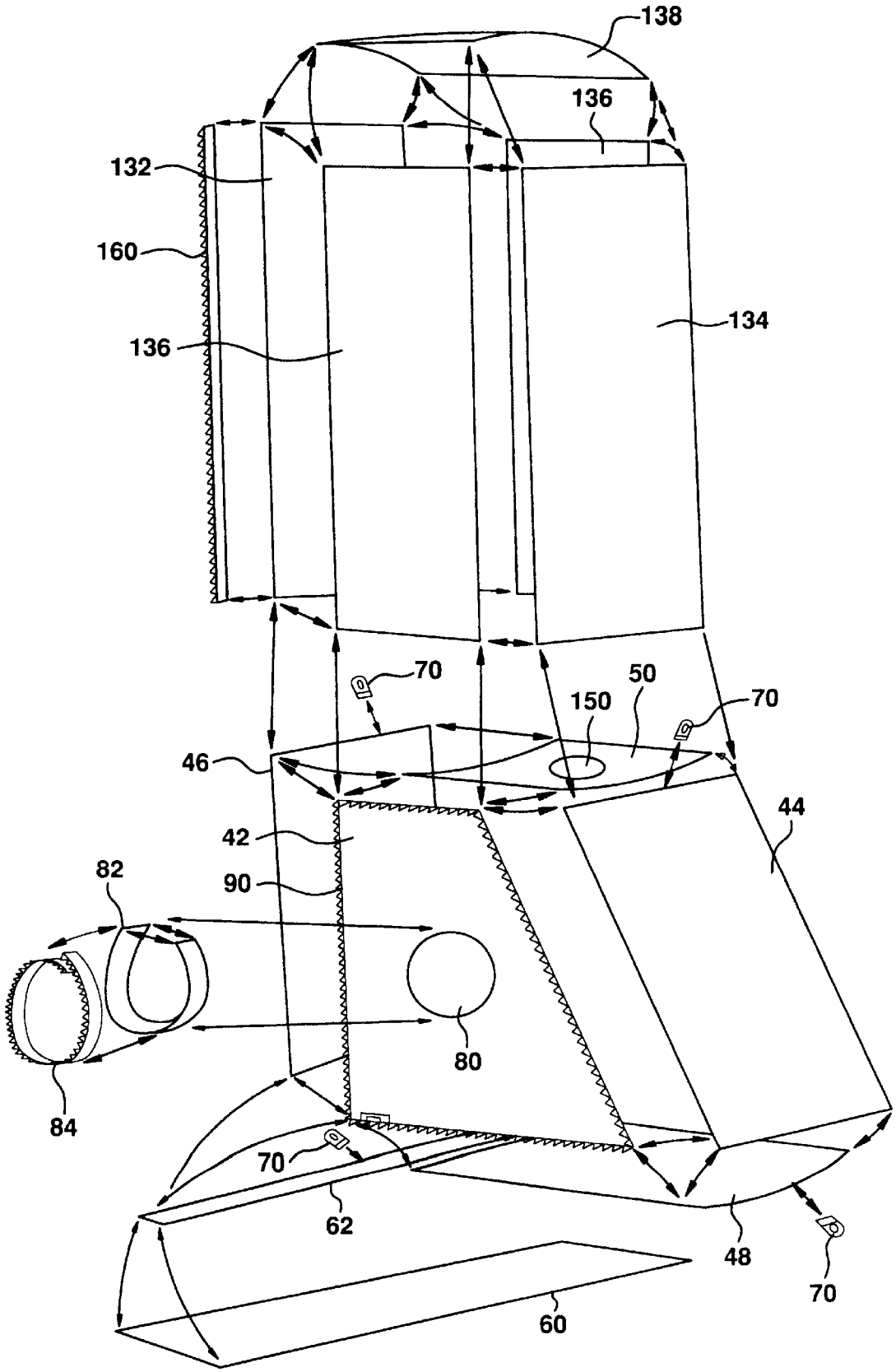
FIG. 9 is an exploded plane view of the base module and inflatable pillar disclosed in FIG. 9 illustrating a connection mechanism incorporated into the front side of the pillar, a connection arrangement on the side of the base module for connecting together two adjacent base modules and the adjacent air portals.

Referring now to FIG. 9, the base module and pillar structure of FIG. 8 is modified to include a pillar net zipper 160 stitched to the front edge of the pillar. The net zipper is designed to be attached to a net to extend a net between an adjacent pillar as shown in FIG. 13. Base module 40 has also been modified to include a side zipper 90 positioned on the peripheral edge of the side panel 42 and a portal zipper and zipper strip attached to the air portal in side panel 42. A base module including a pillar and a side zipper is illustrated in FIG. 13 and is positioned at the end of the sectional unit. As schematically illustrated in FIG. 1, base modules which include inflatable pillars are preferably positioned at the two ends of the skating rink and are designed to support netting between the pillars. The netting may be attached to the top edge of the base module by clip tabs 70 and/or a zipper arrangement, not shown, or by some other mechanism. By using the modified base modules disclosed in FIGS. 6–9, a net can be supported about the inner perimeter of the inflatable skating rink.

Figure 10:
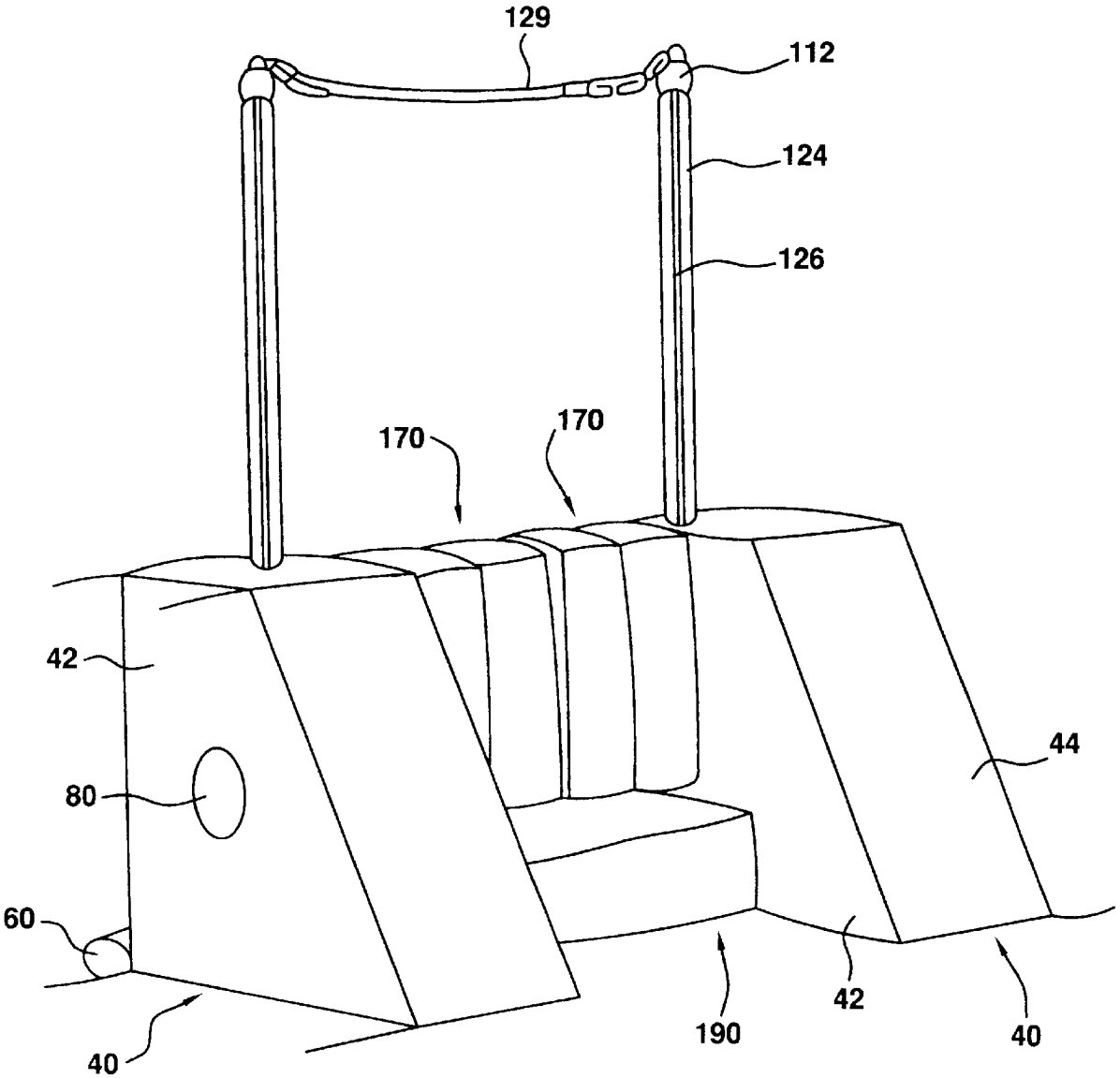
FIG. 10 is a plan view of inflatable door and platform arrangement connected between two base modules.
Figure 11:
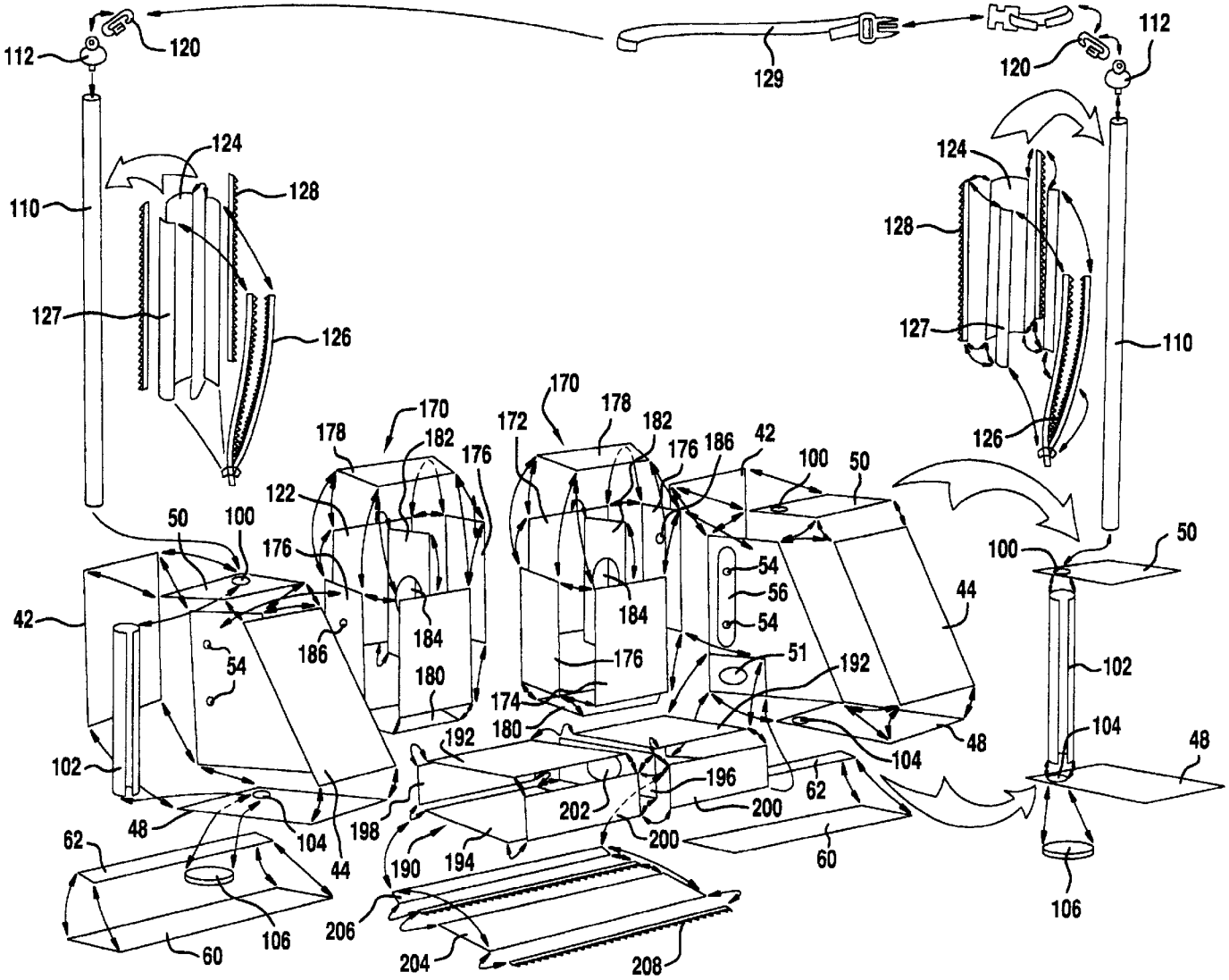
FIG. 11 is an exploded plane view of the inflatable door and platform arrangement of FIG. 10.

Referring again to FIG. 1, the inflatable rink includes one or more access points which are defined by side doors 170 and platform 190. These structures are illustrated in FIGS. 10 and 11. The access point of the inflatable rink includes two modified base modules as disclosed in FIGS. 6 and 7 which have been further modified to include a side door 170 and a platform 190. As illustrated in FIG. 10, two side doors 170 are positioned between the two base modules. One side door is attached to each base module. The platform 190 is positioned beneath the base of the two doors and is connected at each end to a base module. Each side door 170 includes a front panel 172, back panel 174, two side panels 176, a top panel 178 and a bottom panel 180. The side door panels are preferably made of the same material as the panels of the base module. The panels of the side door are stitched together so as to minimize fluid leakage from the door when inflated. Side door 170 also includes an inner partition 182, preferably centered in the interior of the side door, to divide the interior of the side door in substantially two equal parts. Partition 182 includes a partition portal 184 to allow fluid to pass between the two chambers within the interior of the side door. The use of the inner partition and partition portal helps to insure the proper inflation of the side door. Preferably, the partition portal is positioned substantially in the center of the inner partition and has a size which is less than the surface area of the inner partition. Preferably, the size of the partition portal is less than 20% of the surface area of the partition and is more preferably 2–12% of the surface area of the partition. Side panel 176 which is positioned adjacent to base module 40 includes two side holes 186. The base module also includes two side door holes 54 in the side panel. The holes in the side door and side panel are positioned so that the holes are in substantial alignment when the side door is connected to the side panel of the base module. Side door holes 186 are preferably positioned at a substantially equal distance from the ends of the side panel and are positioned substantially in the middle of the side panel. Side holes 186 and side door holes 54 are designed to be substantially of the same size and have a size which is smaller than the surface area of the side panel of the side door and of the side panel of the base module respectively. Preferably, the size of the side holes 186 is less than 20% of the surface area of the side panel and is more preferably 0.1–10% of the surface area of the side panel. The side door holes 54 and door side holes 186 provide for fluid communication between the interior of the base module and the interior of the side door thereby providing for the mutual inflation and deflation of these components. A door strip 156 is preferably positioned about side door holes 154 to provide for reinforcement to side door holes and the side panel 42. Preferably, side door 170 is stitched onto door strip 56; however, it will be appreciated that the side door can be attached to the base module by a quick connect mechanism such as a zipper. As best illustrated in FIG. 10, side doors 170 is mounted onto base module 40 so that the top panel of the side door is substantially flush with the top panel of the base module and the front panel of the side door is substantially flush with the front panel of the base module. The width of the side panel of the side door is preferably about one half the width of the top panel of the base module. The height of the side panel of the side door is preferably less than the height of the side panel of the base module. This height difference allows for the side doors to be mounted above platform 190. The design and mounting of side doors allows for the doors to be swung open and closed thereby creating the desired access into and out of the inflatable skating rink. When the base module and side door is inflated, the side door extends substantially perpendicular from the side of the base module. Therefore, the side doors remain in this position until the side door is pushed into a different position. Once the force on the door is eliminated, the door swings back into its original position.

Platform 190 is positioned between the base modules and is preferably connected to the bottom of the two base modules by stitching. The platform includes a top panel 192, a bottom panel 194, a front panel 198 and a back panel 200. The platform panels are preferably made of the same material as the panels of the base module. The panels are stitched together so as to minimize fluid leakage. Positioned on the side panel 42, adjacent to the bottom front end of the side panel, is a platform port 51 which provides fluid communication between the interior of the base module and the interior of the platform. The platform preferably includes a platform partition 196 which separates the interior of the platform into two substantially equal sections. Platform partition 196 includes a partition portal 202 which is designed to insure that the platform is properly inflated during operation. Platform 190 further includes a base guard 204 which is connected to a guard strip 206 which in turn is connected to the front edge of platform bottom 194 and the bottom edge of platform front panel 198. The guard strip 206 is preferably made of a mesh similar in design to the guard strip 62 of the base module. Base guard 204 may include a strip zipper 208 designed to form a connection to the base guard strip for easy removal and assembly of the base guard onto the platform 190. The width of the platform is preferably greater than the width of the side doors but less than the length of the bottom panel of the base module. Preferably, the width of the platform is at least about twice the width of the side doors. A platform protection cover, not shown, may be attached to the top panel of the platform to protect the platform against being inadvertently punctured or damaged. This cover can be stitched to the platform or may be designed so it can be quickly removed and attached to the top of the platform such as by a zipper.

Referring now to FIGS. 10 and 11, the poles 110 positioned in the two base modules include a pole cover 124 which is connected together by cover zipper 126. The pole cover may include a padded material. The pole cover includes a net zipper 128 designed to connect to net 122, not shown. A pole strap 129 is connected between the top of the poles on each side of the inflatable doors. The pole strap is designed to maintain the poles in position since netting is preferably not positioned between the two poles to allow easy access into and out of the inflatable skating rink through the side doors. As can be appreciated, the pole cover 124 may be inserted on other poles positioned about the inflatable rink.

Figure 12:
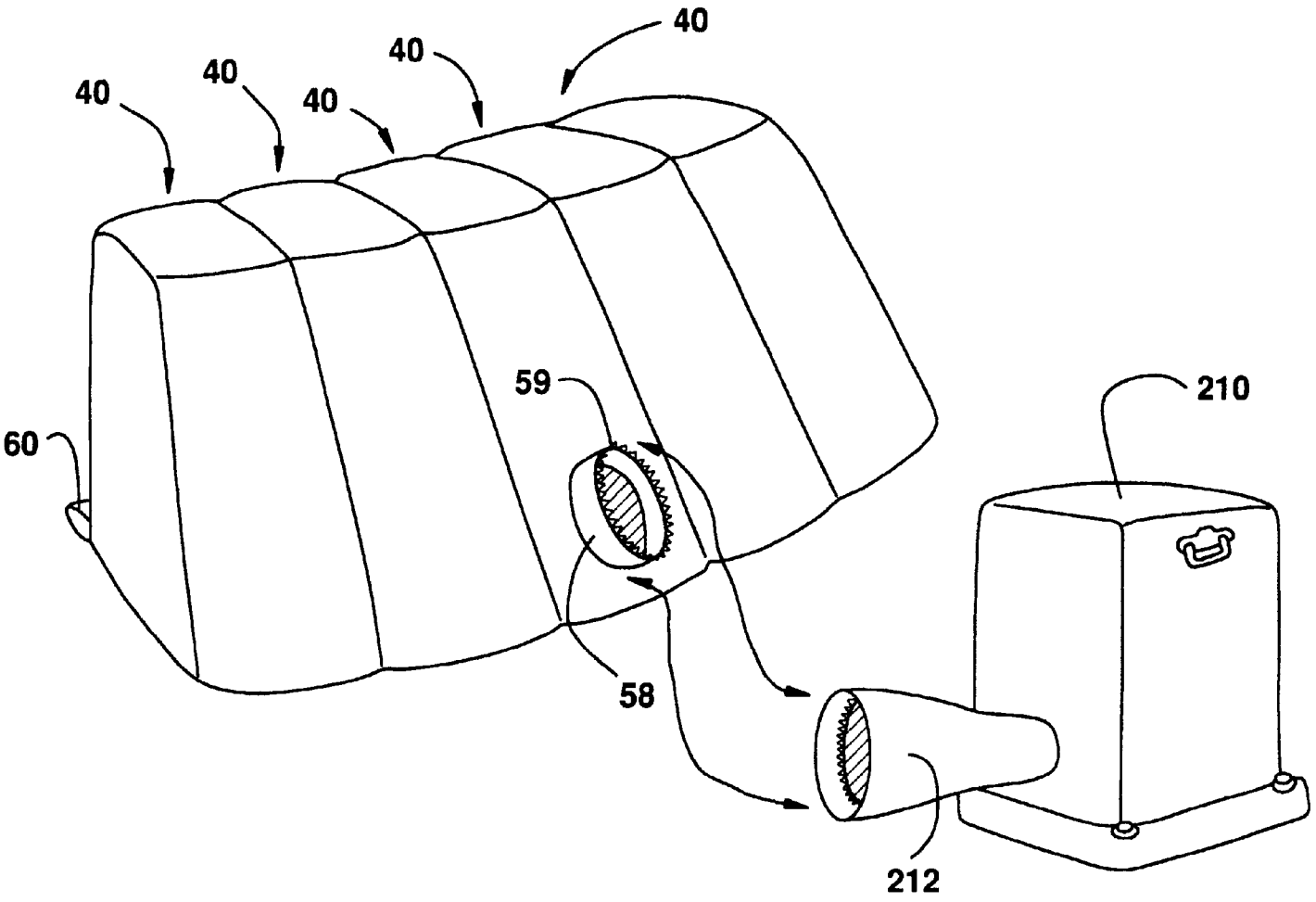
FIG. 12 is plane view of a modular section illustrating five base modules connected together and including a blower port positioned in the back of one of the base panels of a base module for providing a connection to a blower.

Referring now to FIG. 12, a portion of a section unit of base modules is illustrated. Also illustrated is an air blower 210 having a blower nozzle 212 which is attached to a blower port 58 of one of the base modules 40. Blower port 58 is positioned on the back panel 44 of the base module and preferably includes a port zipper 59 and/or a Velcro connection designed to secure blower nozzle 212 to the blower port. Air blower 210 is designed to direct a fluid such as air into the interior of base module 40 and thereby inflate the base module. Once the base module begins to inflate, air in the interior of the base module begins to pass through air portal 80 positioned on both side panels of the base module to begin the inflation of adjacently positioned base modules until all the connected base modules are inflated. For a regulation size inflatable hockey rink four blowers are preferably used to inflate the rink and the blowers and are positioned preferably at the four corners of the rink to maintain the proper inflation of the inflatable rink. During the operation of the rink, the blowers are preferably maintained in operation to insure that the inflatable skating rink is properly inflated at all times.

The invention has been described with reference to the preferred embodiment and alternates thereof. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

I claim:

1. An inflatable skating rink comprising of a plurality of base modules positioned adjacent of one another to define a perimeter of said skating rink, each of said base modules comprising a flexible material which is substantially non-permeable to air, air communication means for providing air passage between at least one pair of adjacently positioned base modules, and modular connection means for connecting together said at least one pair of adjacently positioned base modules.

2. A skating rink as defined in claim 1, wherein said air communication means includes an air port positioned on a side of one said base module for communication with an air port of an adjacent base module.

3. A skating rink as defined in claim 2, wherein said modular connection means encircles said air communication means thereby forming a secondary seal about said air ports.

4. A skating rink as defined in claim 3, wherein at least one base module includes a blower port and blower port connection means for connecting a blower outlet to said blower port.

5. A skating rink as defined in claim 3, wherein at least one base module includes an inflatable base guard attached to the front bottom of said at least one base module.

6. A skating rink as defined in claim 3, wherein at least one base module includes air vacating means for providing air passage to deflate said skating rink.

7. A skating rink as defined in claim 3, wherein at least one base module includes an inflatable pillar section connected to a top of said at least one base module, said pillar section in air communication with an interior of said at least one base module.

8. A skating rink as defined in claim 3, wherein at least one base module includes a pole support.

9. A skating rink as defined in claim 3, wherein at least one base module includes an inflatable door connected to a side of said at least one base module, the inflatable door in air communication with an interior of said at least one base module.

10. A skating rink as defined in claim 3, wherein at least one base module includes an inflatable base section connected to a bottom side of said at least one base module, said inflatable base section in air communication with an interior of said at least one base module.

11. A skating rink as defined in claim 2, including air port connection means for connecting together two air ports of two adjacent base modules thereby forming a substantially air tight seal.

12. A skating rink as defined in claim 11, wherein said air port connection means includes a connection arrangement selected from the group consisting of a zipper, hook and loop fastener and combinations thereof positioned about the peripheral edge of said ports.

13. A skating rink as defined in claim 12, wherein said modular connection means encircles said air communication means thereby forming a secondary seal about said air ports.

14. A skating rink as defined in claim 13, wherein said modular connection means includes a zipper.

15. A skating rink as defined in claim 14, wherein at least one base module includes an inflatable base guard attached to the front bottom of said at least one base module.

16. A skating rink as defined in claim 14, wherein at least one base module includes air vacating means for providing an air passage to deflate said skating rink.

17. A skating rink as defined in claim 14, wherein at least one base module includes an inflatable pillar section connected to a top of said at least one base module, said pillar section in air communication with an interior of said at least one base module.

18. A skating rink as defined in claim 14, wherein at least one base module includes a pole support.

19. A skating rink as defined in claim 14, wherein at least one base module includes an inflatable door connected to a side of said at least one base module, the inflatable door in air communication with an interior of said at least one base module.

20. A skating rink as defined in claim 14, wherein at least one base module includes an inflatable base section connected to a bottom side of said at least one base module, said inflatable base section in air communication with an interior of said at least one base module.

21. A skating rink as defined in claim 14, wherein at least one base module includes a blower port and blower port connection means for connecting a blower outlet to said blower port.

22. A skating rink as defined in claim 1, wherein at least one base module includes a blower port and blower port connection means for connecting blower outlet to said blower port.

23. A skating rink as defined in claim 22, wherein said blower port connection means includes a zipper which is adapted to form a connection between blower and said blower port.

24. A skating rink as defined in claim 1, wherein at least one base module includes an inflatable base guard attached to the front bottom of said at least one base module.

25. A skating rink as defined in claim 24, wherein said inflatable base guard is in air communication with an interior of said at least one base module.

26. A skating rink as defined in claim 1, wherein at least one base module includes air vacating means for providing air passage to deflate said skating rink.

27. A skating rink as defined in claim 26, wherein said vacating means includes a zipper positioned on a back of at least one base module, said zipper moveable between an open and a closed position, said closed position inhibiting air from flowing through said vacating means.

28. A skating rink as defined in claim 1, wherein at least one base module includes an inflatable pillar section connected to a top of said at least one base module, said pillar section in air communication with an interior of said at least one base module.

29. A skating rink as defined in claim 28, wherein at least one base module includes a pillar air port in a top of said at least one base module which provides an air passage between said at least one base module and said pillar section, said pillar air port having a cross-section area which is less than the cross-section area of said pillar section.

30. A skating rink as defined in claim 28, wherein at least one base module having a pillar section includes air vacating means for providing an air passage to deflate said skating rink.

31. A skating rink as defined in claim 28, wherein said pillar section includes a net connection means for attaching netting to said pillar section.

32. A skating rink as defined in claim 31, wherein said connection means includes a zipper positioned on the front side edge of said pillar section and extending substantially the full length of said front side edge.

33. A skating rink as defined in claim 1, wherein at least one base module includes a pole support.

34. A skating rink as defined in claim 33, wherein said pole support includes a pole hole in a top of at least one base module and seal means for forming a substantially air tight seal between said pole hole and the interior of said at least one base module.

35. A skating rink as defined in claim 34, wherein said seal means includes a pole liner extending from the top to a bottom of at least one base module, said pole liner connected to the peripheral edges of said pole hole.

36. A skating rink as defined in claim 1, wherein at least one base module includes an inflatable door connected to a side of said at least one base module, the inflatable door in air communication with an interior of said at least one base module.

37. A skating rink as defined in claim 36, wherein said inflatable door includes a plurality of air chambers in air communication with one another, said air chambers being substantially the same size.

38. A skating rink as defined in claim 37, wherein at least one base module includes an inflatable base section connected to a bottom side of said at least one base module, said inflatable base section in air communication with an interior of said at least one base module.

39. A skating rink as defined in claim 1, wherein at least one base module includes an inflatable base section connected to a bottom side of said at least one base module, said inflatable base section in air communication with an interior of said at least one base module.

40. An inflatable structure comprising a base module and an adjacent inflatable module, said base module made of a flexible material that is substantially non-permeable to air, said base module including an air portal which provides an air passageway between said base module and an adjacent inflatable module, an air portal seal to form a substantially air tight seal between said base module and said adjacent inflatable module, and a connector to connect said base module to said adjacent inflatable module, said base inflatable module and said adjacent inflatable module each including a side wall and said air portal forming an opening in each of said side walls, said air portal having a size to impede air flow between both said base module and said adjacent inflatable module.

41. An inflatable structure as defined in claim 40, wherein said air portal seal means includes a seal selected from the group consisting of a melted seam, a glued seam, a stitched seam, a zipper seam, a snap seam, a button seam, a hook and loop fastener, a tongue & groove seam, a laced seam and combinations thereof.

42. An inflatable structure as defined in claim 41, wherein said base module includes an inflatable step section connected to a bottom side of said base module, said inflatable step section in air communication with an interior of said base module.

43. An inflatable structure as defined in claim 42, wherein said inflatable step section is connected between two base modules.

44. An inflatable structure as defined in claim 42, wherein said base module includes a protective cover for said step section.

45. An inflatable structure as defined in claim 41, wherein said air portal seal means includes a zipper seam.

46. An inflatable structure as defined in claim 41, wherein said air portal seal means includes a stitched seam.

47. An inflatable structure as defined in claim 40, wherein said connector includes a connector selected from the group consisting of a stitched connection, a zipper connection, a melted seam connection, a snap connection, a button connection, a glued connection, a hook and loop fastener, a laced seam, a tongue and groove connection and combinations thereof, said connection means forming a secondary seal about said air portal.

48. An inflatable structure as defined in claim 47, wherein said connector is positioned substantially adjacent to the peripheral edge of said side walls.

49. An inflatable structure as defined in claim 40, wherein a plurality of base modules are connected together to form a skating rink.

50. An inflatable structure as defined in claim 47, wherein said base module includes an inflatable door connected to a side of said base module, said inflatable door in air communication with an interior of said base module.

51. An inflatable structure as defined in claim 47, wherein said base module includes a blower port and blower port connection means for connecting a blower outlet to said blower port, said blower port connection means including a connection selected from the group consisting of a zipper connection, a laced seam, a tongue and groove connection, a hook and loop fastener, a snap connection, a button connection and combinations thereof.

52. An inflatable structure as defined in claim 47, wherein said base module includes an inflatable step section connected to a bottom side of said base module, said inflatable step section in air communication with an interior of said base module.

53. An inflatable structure as defined in claim 47, wherein said base module includes air vacating means for depressurizing said base module, said air vacating means providing a passageway between an interior and exterior of said base module, said vacating means including closure means for opening and closing said passageway wherein the closure of said passageway inhibits passage of air from the interior of said base module.

54. An inflatable structure as defined in claim 47, wherein said base module includes an inflatable base guard connected to a front base of said base module and in air communication with an interior of said base module.

55. An inflatable structure as defined in claim 47, wherein said base module includes an inflatable pillar connected to a top of said base module, said inflatable pillar in air communication with an interior of said base module.

56. An inflatable structure as defined in claim 47, wherein said base module includes a pole support.

57. An inflatable structure as defined in claim 56, wherein said pole support includes a pole opening in a the top of said base module and pole sealing means for forming a substantially air tight seal between said pole opening and an interior of said base module.

58. An inflatable structure as defined in claim 40, wherein said base module includes a blower port and blower port connection means for connecting a blower outlet to said blower port, said blower port connection means including a connection selected from the group consisting of a zipper connection, a laced seam, a tongue and groove connection, a hook and loop fastener, a snap connection, a button connection and combinations thereof.

59. An inflatable structure as defined in claim 40, wherein said base module includes an inflatable base guard connected to a front base of said base module and in air communication with an interior of said base module.

60. An inflatable structure as defined in claim 40, wherein said base module includes air vacating means for depressurizing said base module, said air vacating means providing a passageway between an interior and exterior of said base module, said vacating means including closure means for opening and closing said passageway wherein the closure of said passageway substantially seals air in the interior of said base module.

61. An inflatable structure as defined in claim 40, wherein said base module includes an inflatable pillar connected to a top of said base module, said inflatable pillar in air communication with an interior of said base module.

62. An inflatable structure as defined in claim 51, wherein said inflatable pillar includes net connection means for connecting netting to said inflatable pillar.

63. An inflatable structure as defined in claim 61, including a net support cable in a tension arrangement between two pillars for supporting a net between said pillars.

64. An inflatable structure as defined in claim 40, wherein said base module includes a pole support.

65. An inflatable structure as defined in claim 64, wherein said pole support includes a pole opening in a top of said base module and pole sealing means for forming a substantially air tight seal between said pole opening and an interior of said base module.

66. An inflatable structure as defined in claim 65, wherein said pole seal means includes a pole liner connected around and substantially adjacent to the interior peripheral edge of said pole hole.

67. An inflatable structure as defined in claim 66, wherein said pole liner extends from a top interior to a bottom interior of said base module.

68. An inflatable structure as defined in claim 64, including a net support cable in a tension arrangement between two pole supports for supporting a net between said pole supports.

69. An inflatable structure as defined in claim 45, wherein said air portal being a substantially tubular member.

70. An inflatable structure as defined in claim 69, including an air flow constrictor being attached to said air portal.

71. An inflatable structure as defined in claim 70, wherein said air flow constrictor includes a mesh material.

72. An inflatable structure as defined in claim 40, including an air flow constrictor being attached to said air portal.

73. An inflatable structure as defined in claim 72, wherein said air flow constrictor includes a mesh material.

74. An inflatable structure as defined in claim 40, wherein said base module includes an inflatable door connected to a side of said base module, said inflatable door in air communication with an interior of said base module.

75. An inflatable structure as defined in claim 74, wherein said inflatable door includes a plurality of interior chambers, said interior chambers in air communication with one another.

76. An inflatable structure comprising a base module and an adjacent structure, said base module made of a substantially non-air permeable material, said base module including an air portal which provides an impeded air passageway between said base module and said adjacent structure, a connector to connect said base module to said adjacent structure, and an inflatable base guard connected to a front base of said base module, said inflatable base guard in air communication with an interior of said base module substantially at said front base of said base module and including an air constrictor being positioned between said base module and in flatable base guard, said base module an said adjacent structure share a common wall and said air portal being positioned in said common wall, said air portal impeding air by a construction which includes an air flow constrictor attached to said air portal.

77. An inflatable structure comprising a base module and an adjacent structure, said base module made of a flexible material that is substantially non-permeable to air, said base module including an air portal which provides an air passageway between said base module and said adjacent structure, an air flow constrictor, and a connector to connect said base module to said adjacent structure, said air flow constrictor being attached to said air portal, said connector forming a substantially air tight seal between said base module and said adjacent structure.

78. An inflatable structure as defined in claim 77, including an air portal seal to form a substantially air tight seal between said base module and said adjacent structure.

79. An inflatable structure as defined in claim 78, wherein said air portal seal includes a seal selected from the group consisting of a melted seam, a glued seam, a stitched seam, a zipper seam, a snap seam, a button seam, a hook and loop fastener, a tongue & groove seam, a laced seam and combinations thereof.

80. An inflatable structure as defined in claim 77, wherein said base module is a first base module and said adjacent structure is a second base module, said first and said second base module including a side wall wherein each side wall has a substantially the same size surface area, said air portal has a cross-sectional area which is substantially smaller than said surface area of at least one of said side walls.

81. An inflatable structure as defined in claim 77, wherein said base module includes a blower port and a blower port connector to connect a blower outlet to said blower port, said blower port connector including a connection selected from the group consisting of a zipper connection, a laced seam, a tongue and groove connection, a hook and loop fastener, a snap connection, a button connection and combinations thereof.

82. An inflatable structure as defined in claim 77, wherein said base module includes an inflatable base guard connected to a front base of said base module and in air communication with an interior of said base module.

83. An inflatable structure as defined in claim 77, wherein said base module includes an air vacator to depressurize said base module, said air vacator providing a passageway between an interior and exterior of said base module, said vacator including a closure to open and close said passageway wherein the closure of said passageway substantially seals air in the interior of said base module.

84. An inflatable structure as defined in claim 77, wherein said base module includes an inflatable pillar connected to a top of said base module, said inflatable pillar in air communication with an interior of said base module.

85. An inflatable structure as defined in claim 84, wherein said inflatable pillar includes a net connector to connect netting to said inflatable pillar.

86. An inflatable structure as defined in claim 77, wherein said base module includes a pole support.

87. An inflatable structure as defined in claim 86, wherein said pole support includes a pole opening in the top of said base module and a pole seal to form a substantially air tight seal between said pole opening and an interior of said base module.

88. An inflatable structure as defined in claim 77, said base module including a pole seal having a pole liner connected around and substantially adjacent to the interior peripheral edge of a pole hole.

89. An inflatable structure as defined in claim 77, wherein said base module includes an inflatable door connected to a side of said base module, said inflatable door in air communication with an interior of said base module.

90. An inflatable structure as defined in claim 77, wherein said base module includes an inflatable step section connected to a bottom side of said base module, said inflatable step section in air communication with an interior of said base module.

91. An inflatable structure as defined in claim 77, wherein a plurality of base modules are connected together to form a skating rink.

92. An inflatable structure as defined in claim 77, wherein said air portal being a substantially tubular member.

93. An inflatable structure as defined in claim 77, wherein said air flow constrictor includes a mesh material.

94. An inflatable structure as defined in claim 77, where base module and said adjacent structure share a common wall, said air portal located in the common wall.

95. An inflatable structure as defined in claim 94, wherein said air portal has a cross-sectional area which is substantially smaller than the surface area of said common wall.

96. An inflatable structure comprising a base module and an adjacent structure, said base module made of a substantially non-air permeable material, said base module including an air portal which provides an impeded air passageway between said base module and said adjacent structure, a connector to connect said base module to said adjacent structure, an inflatable pillar connected to a top of said base module and a flow constrictor, said inflatable pillar in air communication with the interior of said base module and said flow constrictor impeding air flow at least from said base module to said inflatable pillar, said base module and said adjacent structure sharing a common wall and said air portal being positioned in said common wall, said air portal impeding air flow at least from said base module to said adjacent module.

97. An inflatable structure as defined in claim 96, wherein said inflatable pillar includes a net connector to connect netting to said inflatable pillar.

98. An inflatable structure as defined in claim 96, wherein said air portal impeding air by a construction which includes an arrangement selected from the group consisting of an air flow constrictor attached to said air portal, an air portal having a surface area smaller than the surface area of said common wall, and combinations thereof.

99. An inflatable structure as defined in claim 96, including an air constrictor being positioned between said base module and inflatable pillar.

100. An inflatable structure comprising a base module and an adjacent structure, said base module made of a substantially non-air permeable material, said base module including a pole support, an air portal which provides an impeded air passageway between said base module and said adjacent structure, a connector to connect said base module to said adjacent structure, said pole support including opening in a top of said base module and a pole seal to form a substantially air tight seal between said pole opening and the interior of said base module.

101. An inflatable structure as defined in claim 100, wherein said base module and said adjacent structure share a common wall and said air portal being positioned in said common wall, said air portal impeding air by a construction which includes an arrangement selected from the group consisting of an air flow constrictor attached to said air portal, an air portal having a surface area smaller than the surface area of said common wall, and combinations thereof.

102. An inflatable structure as defined in claim 100, wherein said pole support is at least partially positioned within said base module.

103. An inflatable structure comprising a base module and an adjacent structure, said base module made of a substantially non-air permeable material, said base module including an air portal which provides an impeded air passageway between said base module and said adjacent structure, a connector to connect said base module to said adjacent structure, and an inflatable door connected to a side of said base module, said inflatable door in air communication with an interior of said base module.

104. An inflatable structure as defined in claim 103, wherein said base module and said adjacent structure share a common wall and said air portal being positioned in said common wall, said air portal impeding air by a construction which includes an arrangement selected from the group consisting of an air flow constrictor attached to said air portal, an air portal having a surface area smaller than the surface area of said common wall, and combinations thereof.

105. An inflatable structure as defined in claim 103, including an air constrictor being positioned between said base module and said inflatable door.

106. An inflatable structure comprising a base module and an adjacent structure, said base module made of a substantially non-air permeable material, said base module including an air portal which provides an, impeded air passageway between said base module and said adjacent structure, a connector to connect said base module to said adjacent structure, and an inflatable step section connected to a bottom side of said base module, said inflatable step section in air communication with an interior of said base module.

107. An inflatable structure as defined in claim 106, wherein said base module and said adjacent structure share a common wall and said air portal being positioned in said common wall, said air portal impeding air by a construction which includes an arrangement selected from the group consisting of an air flow constrictor attached to said air portal, an air portal having a surface area smaller than the surface area of said common wall, and combinations thereof.

108. An inflatable structure as defined in claim 106, including an air constrictor positioned between said base module and said inflatable step section.

* * * * *